US008940361B2

(12) United States Patent
Smith et al.

(10) Patent No.: US 8,940,361 B2
(45) Date of Patent: Jan. 27, 2015

(54) SELF-LUBRICATING SURFACES FOR FOOD PACKAGING AND FOOD PROCESSING EQUIPMENT

(75) Inventors: Jonathan David Smith, Cambridge, MA (US); Rajeev Dhiman, Malden, MA (US); Adam T. Paxson, Cambridge, MA (US); Christopher J. Love, Atlantis, FL (US); Brian R. Solomon, Rockville, MD (US); Kripa K. Varanasi, Lexington, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 13/517,552

(22) Filed: Jun. 13, 2012

(65) Prior Publication Data

US 2013/0251952 A1 Sep. 26, 2013

Related U.S. Application Data

(60) Provisional application No. 61/651,545, filed on May 24, 2012, provisional application No. 61/614,941, filed on Mar. 23, 2012.

(51) Int. Cl.
*B32B 3/30* (2006.01)

(52) U.S. Cl.
USPC ..... 427/180; 427/203; 428/161

(58) Field of Classification Search
CPC ..... C23C 4/04
USPC ..... 427/180, 203; 428/161
See application file for complete search history.

(56) References Cited

U.S. PATENT DOCUMENTS

| | | | | |
|---|---|---|---|---|
| 4,069,933 | A | 1/1978 | Newing | |
| 4,204,021 | A * | 5/1980 | Becker | 428/325 |
| 4,316,745 | A * | 2/1982 | Blount | 106/287.34 |
| 5,624,713 | A | 4/1997 | Ramer | |
| 5,853,802 | A * | 12/1998 | Boyer et al. | 427/207.1 |
| 7,622,197 | B2 * | 11/2009 | Balow et al. | 428/469 |
| 7,887,934 | B2 | 2/2011 | Gentleman et al. | |
| 7,892,660 | B2 | 2/2011 | Gentleman et al. | |
| 7,897,271 | B2 | 3/2011 | Gentleman et al. | |
| 7,901,798 | B2 | 3/2011 | Gentleman et al. | |
| 7,977,267 | B2 | 7/2011 | Gentleman et al. | |

(Continued)

FOREIGN PATENT DOCUMENTS

| | | | |
|---|---|---|---|
| CN | 100344341 | C | 10/2007 |
| CN | 101269960 | B | 5/2011 |

(Continued)

OTHER PUBLICATIONS

International Search Report of PCT/US12/30370, dated Oct. 15, 2012, 6 pages.

(Continued)

*Primary Examiner* — Nathan T Leong
(74) *Attorney, Agent, or Firm* — Choate, Hall & Stewart LLP

(57) ABSTRACT

In certain embodiments, the invention relates to an article having a liquid-impregnated surface. The surface includes a matrix of solid features (e.g., non-toxic and/or edible features) spaced sufficiently close to stably contain a liquid therebetween or therewithin, wherein the liquid is non-toxic and/or edible. The article may contain, for example, a food or other consumer product, such as ketchup, mustard, or mayonnaize.

15 Claims, 17 Drawing Sheets

(56) References Cited

U.S. PATENT DOCUMENTS

| | | | | |
|---|---|---|---|---|
| 8,057,922 | B2 | 11/2011 | Gentleman et al. | |
| 8,057,923 | B2 | 11/2011 | Gentleman et al. | |
| 8,062,775 | B2 | 11/2011 | Gentleman et al. | |
| 8,173,279 | B2 | 5/2012 | Gentleman et al. | |
| 8,178,219 | B2 | 5/2012 | Gentleman et al. | |
| 8,222,172 | B2 | 7/2012 | Gentleman et al. | |
| 8,236,432 | B2 | 8/2012 | Gentleman et al. | |
| 8,574,704 | B2 | 11/2013 | Smith et al. | |
| 2002/0164443 | A1 | 11/2002 | Oles et al. | |
| 2003/0096083 | A1* | 5/2003 | Morgan et al. | 428/141 |
| 2004/0026832 | A1 | 2/2004 | Gier et al. | |
| 2004/0219373 | A1 | 11/2004 | Deruelle et al. | |
| 2005/0016489 | A1 | 1/2005 | Endicott et al. | |
| 2005/0112326 | A1 | 5/2005 | Nun et al. | |
| 2005/0208272 | A1* | 9/2005 | Groll | 428/172 |
| 2006/0013735 | A1 | 1/2006 | Engelking et al. | |
| 2006/0147675 | A1 | 7/2006 | Nun et al. | |
| 2008/0085070 | A1 | 4/2008 | Hirata et al. | |
| 2008/0118763 | A1 | 5/2008 | Balow et al. | |
| 2009/0155609 | A1 | 6/2009 | Gentleman et al. | |
| 2009/0231273 | A1 | 9/2009 | Lashina et al. | |
| 2010/0092621 | A1 | 4/2010 | Akutsu et al. | |
| 2010/0285229 | A1 | 11/2010 | Elbahri et al. | |
| 2011/0077172 | A1 | 3/2011 | Aizenberg et al. | |
| 2011/0283778 | A1 | 11/2011 | Angelescu et al. | |
| 2012/0036846 | A1 | 2/2012 | Aizenberg et al. | |
| 2013/0032316 | A1 | 2/2013 | Dhiman et al. | |
| 2013/0034695 | A1 | 2/2013 | Smith et al. | |
| 2013/0062285 | A1 | 3/2013 | Hoek et al. | |
| 2013/0146536 | A1 | 6/2013 | Tarabara et al. | |
| 2013/0220813 | A1 | 8/2013 | Anand et al. | |
| 2013/0251769 | A1 | 9/2013 | Smith et al. | |
| 2013/0251942 | A1 | 9/2013 | Azimi et al. | |
| 2013/0251946 | A1 | 9/2013 | Azimi et al. | |
| 2013/0251952 | A1 | 9/2013 | Smith et al. | |
| 2013/0333789 | A1 | 12/2013 | Smith et al. | |
| 2013/0335697 | A1 | 12/2013 | Smith et al. | |
| 2013/0337027 | A1 | 12/2013 | Smith et al. | |

FOREIGN PATENT DOCUMENTS

| | | | |
|---|---|---|---|
| DE | 198 18 956 | A1 | 11/1998 |
| JP | 1 170932 | A | 7/1989 |
| JP | 5 240251 | A | 9/1993 |
| JP | 2004 037764 | A | 2/2004 |
| JP | 2008240910 | A | 10/2008 |
| TW | I 233 968 | B | 6/2005 |
| WO | WO-93/17077 | A1 | 9/1993 |
| WO | WO-99/36490 | A1 | 7/1999 |
| WO | WO-02/062568 | A2 | 8/2002 |
| WO | WO-03/071275 | A1 | 8/2003 |
| WO | WO-2006/017009 | A2 | 2/2006 |
| WO | WO-2006/091235 | A1 | 8/2006 |
| WO | WO-2007/019362 | A1 | 2/2007 |
| WO | WO-2008/111603 | A1 | 9/2008 |
| WO | WO-2010/082710 | A1 | 7/2010 |
| WO | WO-2010/129807 | A1 | 11/2010 |
| WO | WO-2011/087458 | A1 | 7/2011 |
| WO | WO-2011/143371 | A1 | 11/2011 |
| WO | WO-2012/024099 | A1 | 2/2012 |
| WO | WO-2012/100099 | A2 | 7/2012 |
| WO | WO-2012/100100 | A2 | 7/2012 |
| WO | WO-2013/022467 | A2 | 2/2013 |
| WO | WO-2013/130118 | A1 | 9/2013 |
| WO | WO-2013/141888 | A1 | 9/2013 |
| WO | WO-2013/141953 | A2 | 9/2013 |

OTHER PUBLICATIONS

Written Opinion of PCT/US12/30370, dated Oct. 15, 2012, 10 pages.
International Search Report of PCT/US12/42326 dated Dec. 3, 2012, 4 pages.
Written Opinion of PCT/US12/42326 dated Dec. 3, 2012, 7 pages.
Cao et al., Anti-Icing Superhydrophobic Coatings, Langmuir Letter, 2009, A-E.
Furmidge, Studies at Phase Interfaces, Journal of Colloid Science, 1962, 17: 309-324.
Jung et al., Are Superhydrophobic Surfaces Best for Icephobicity?, Langmuir, 2001, 27: 3059-3066.
Kulinich et al., Ice Adhesion on Super-Hydrophobic Surfaces, Applied Surface Science, 2009, 225: 8153-8157.
Meuler et al., Exploiting Topographical Texture to Impact Icephobicity, ACS Nano, 2010, 4(12): 7048-7052.
Mishchenko et al., Design of Ice-free Nanostructured Surfaces Based on Repulsion of Impacting Water Droplets, ACS Nano, 2010, 4(12): 7699-7707.
Seiwert et al., Coating of a Textured Solid, J. Fluid Mech., 2011, 669: 55-63.
Song et al., Superhydrophobic Surfaces Produced by Applying a Self-Assembled Monolayer to Silicon Micro/Nano-Textured Surfaces, Nano Research, 2009, 2: 143-150.
Varanasi et al., Frost Formation and Ice Adhesion on Superhydrophobic Surfaces, Applied Physics Letters, 2010, 97: 234102.
Holden et al., The Use of Organic Coatings to Promote Dropwise Condensation of Steam, Journal of Heat Transfer, 109: 768-774 (1987).
Hejazi et al., Wetting Transitions in Two-, Three-, and Four-Phase Systems, Langmuir, 28:2173-2180 (2012).
Lafuma et al., Slippery Pre-Suffused Surfaces, A Letters Journal Exploring the Frontiers of Physics, 96: 56001p1-56001p4 (2011).
Liu et al., Metallic Surfaces with Special Wettability, Nanoscale, 3:825-238 (2011).
Quere et al., Non-Sticking Drops, Reports on Progress in Physics, 68: 2495-2532 (2005).
Rausch et al., On the Characteristics of Ion Implanted Metallic Surgaces Inducing Dropwise Condensation of Steam, Langmuir, 26(8): 5971-5975 (2010).
Varanasi et al., Spatial Control in the Heterogeneous Nucleation of Water, Applied Physics Letters, 95: 094101-01-03 (2009).
Wong et al., Bioinspired Self-Repairing Slippery Surfaces with Pressure-Stable Omniphobicity, Nature, 477:443-447 (2011).
Zhao et al., Dropwise condensation of Steam on Ion Implanted Condenser Surfaces, Heat Recovery Systems & CHP, 14(5): 525-534 (1994).
Allain et al., A New Method for Contact-Angle Measurements of Sessile Drops, Journal of Calloid and Interface Science, vol. 107, No. 1, Sep. 1985, 9 pages.
Anand et al., Enhanced Condensation on Lubricant-Impregnated Nanotextured Surfaces. ACS Nano, 6(11):10122-10129 (2012).
Antonini et al., Water Drops Dancing on Ice: How Sublimation Leads to Drop Rebound, PRL 111, 014501 (2013).
Arkles, Hydrophobicity, Hydrophilicity and Silanes, Paint and Coatings Industry, Oct. 1, 2006, 10 pages.
Ashkin et al., Optical levitation by radiation pressure. Applied Physics Letters, 19(8):283-285 (1971).
Ashkin et al., Optical levitation of liquid drops by radiation pressure. Science, 187(4181):1073-1075 (1975).
Avedisian et al., Leidenfrost boiling of methanol droplets on hot porous/ceramic surfaces. International Journal of Heat and Mass Transfer, 30(2):379-393 (1987).
Baier et al., Propulsion Mechanisms for Leidenfrost Solids on Ratchet Surfaces. arXiv preprint arXiv:1208.5721 (2012).
Baier et al., Propulsion mechanisms for Leidenfrost solids on ratchets. Physical Review E—Statistical, Nonlinear, and Soft Matter Physics, 87(2) (2013).
Barnes, Geoff T., The Potential for Monolayers to Reduce the Evaporation of Water From Large Water Storages, Agricultural Water Management 95, 4:339-353, (2008).
Bauer et al., The insect-trapping rim of Nepenthes pitchers: surface structure and function, Plant Signaling & Behavior, 4 (11): 1019-1023 (2009).
Beaugnon et al., Dynamics of magnetically levitated droplets. Physica B: Condensed Matter, 294-295:715-720 (2001).
Biance et al., Leidenfrost drops. Physics of Fluids, 15(6):1632-1637 (2003).

(56) References Cited

OTHER PUBLICATIONS

Bico et al., Pearl drops. Europhysics Letters, 47(2):220-226 (1999).
Blossey, R., Self-cleaning surfaces—Virtual realities. Nature Materials, 2(5):301-306 (2003).
Bohn et al., Insect aquaplaning: Nepenthes pitcher plants capture prey with the peristome, a fully wettable water-lubricated anisotropic surface, Proceedings of the National Academy of Sciences,14138-14143 (2004).
Burton, et al., Geometry of the Vapor Layer Under a Leidenfrost Drop. Physical Review Letters, 109(7):074301 (2012).
Cassie et al., Wettability of porous surfaces, Transactions of the Faraday Society, 40: 546-551, (1944).
Celestini, et al., Take Off of Small Leidenfrost Droplets. Physical Review Letters, 109(3):034501 (2012).
Chandra et al., Leidenfrost evaporation of liquid nitrogen droplets. Transactions—ASME: Journal of Heat Transfer, 116(4):999-1006 (1994).
Chandra et al., Observations of droplet impingement on a ceramic porous surface. International Journal of Heat and Mass Transfer 35(10):2377-2388 (1992).
Chen et al., A Wettability Switchable Surface by Microscale Surface Morphology Change, Journal of Micromechanics & Microengineering, Institute of Physics Publishing, 17(3): 489-195 (2007).
Cummings et al., Oscillations of magnetically levitated aspherical droplets. Journal of Fluid Mechanics, 224:395-416 (1991).
Deng et al., Nonwetting of impinging droplets on textured surfaces. Applied Physics Letters, 94(13) 133109 1-3 (2009).
Elbahri et al., Anti-lotus effect for nanostructuring at the leidenfrost temperature. Advanced Materials, 19(9):1262-1266 (2007).
Feng et al., Design and creation of superwetting/antiwetting surfaces. Advanced Materials, 18(23):3063-3078 (2006).
Fondecave et al., Polymers as Dewetting Agents, Macromolecules 1998, 31, 9305-9315, 11 pages.
Fujimoto et al., Deformation and rebounding processes of a water droplet impinging on a flat surface above Leidenfrost temperature. Journal of Fluids Engineering, Transactions of the ASME, 118(1):142-149 (1996).
Gao et al., Artificial lotus leaf prepared using a 1945 patent and a commercial textile. Langmuir, 22(14):5998-6000 (2006).
Goldshtik et al., A liquid drop on an air cushion as an analogue of Leidenfrost boiling. Journal of Fluid Mechanics, 166:1-20 (1986).
Gradeck et al., Heat transfer for Leidenfrost drops bouncing onto a hot surface. Experimental Thermal and Fluid Science, 47:14-25 (2013).
Hashmi et al., Leidenfrost levitation: Beyond droplets. Scientific Reports, 2:797:1-4 (2012).
International Preliminary Report on Patentability, PCT/US2011/061498, dated Feb. 13, 2014, 12 pages.
International Search Report and Written Opinion for PCT/US2011/061498, dated Jul. 31, 2012, 17 pages.
International Search Report, PCT/US2011/061898, Apr. 24, 2013, 6 pages.
International Search Report, PCT/US2012/042327, May 16, 2013, 6 pages.
International Search Report, PCT/2013/042771, May 26, 2014, 4 pages.
International Search Report, PCT/US2013/021558, Oct. 11, 2013, 5 pages.
International Search Report, PCT/US2013/028439, Dec. 5, 2013, 6 pages.
International Search Report, PCT/US2013/045731, Nov. 12, 2013, 3 pages.
International Search Report, PCT/US2013/070827, Mar. 27, 2014, 7 pages.
Written Opinion, PCT/2013/042771, May 26, 2014, 7 pages.
Iwasa, et al., 'Electromaglev'—Magnetic levitation of a superconducting disc with a DC field generated by electromagnets: Part 1. Theoretical and experimental results on operating modes, lift-to-weight ratio, and suspension stiffness. Cryogenics, 37(12):807-816, (1997).
Jung et al., Are superhydrophobic surfaces best for icephobicity? Langmuir, 27(6):3059-3066 (2011).
Kim et al., Hierarchical or not? Effect of the length scale and hierarchy of the surface roughness on omniphobicity of lubricant-infused substrates. Nano Letters, 13(4):1793-1799 (2013).
Kim et al., Levitation Time Measurement of Water Drops on the Surface of Liquid Nitrogen, Journal of the Korean Physical Society, vol. 58, No. 6, pp. 1628-1632 (Jun. 2011).
Kim, Heetae, Floating Phenomenon of a Water Drop on the Surface of Liquid Nitrogen, Journal of the Korean Physical Society, vol. 49, No. 4, pp. L1335-L1338 (Oct. 2006).
Lagubeau et al., Leidenfrost on a ratchet. Nature Physics, 7(5):395-398 (2011).
Lee et al., Dynamic Wetting and Spreading Characteristics of a Liquid Droplet Impinging on Hydrophobic Textured Surfaces, Langmuir, (2011), 27, 6565-6573.
Leidenfrost, J. G., On the fixation of water in diverse fire. International Journal of Heat and Mass Transfer, 9(11):1153-1166 (1966).
Li et al., Dynamic Behavior of the Water Droplet Impact on a Textured Hydrophobic/Superhydrophobic Surface: The Effect of the Remaining Liquid Film Arising on the Pillars' Tops on the Contact Time, Langmuir, (2010), 26(7), 4831-4838.
Linke et al., Self-propelled leidenfrost droplets. Physical Review Letters, 96(15) (2006).
Marin et al., Capillary droplets on Leidenfrost micro-ratchets. arXiv preprint arXiv:1210.4978 (2012).
Mills, A. A., Pillow lavas and the Leidenfrost effect. Journal of the Geological Society, 141(1):183-186 (1984).
Onda et al., Super-water-repellent fractal surfaces. Langmuir, 12(9) (1996).
Ou et al., Laminar drag reduction in microchannels using ultrahydrophobic surfaces. Physics of Fluids, 16(12):4635-4643 (2004).
Park et al., A Numerical Study of the Effects of Superhydrophobic Surface on Skin-Friction Drag in Turbulent Channel Flow, Phys. Fluids 25, 110815 (2013).
Piroird et al., Magnetic control of Leidenfrost drops. Physical Review E—Statistical, Nonlinear, and Soft Matter Physics, 85(5) (2012).
Pozzato et al., Superhydrophobic surfaces fabricated by nanoimprint lithography, Microelectronic Engineering, 83, (2006), 884-888.
Prat et al., On the effect of surface roughness on the vapor flow under Leidenfrost-Levitated droplets. Journal of Fluids Engineering, Transactions of the ASME, 117(3):519-525 (1995).
Quéré et al., Surfing the hot spot. Nature Materials, 5(6):429-430 (2006).
Quéré, D., Leidenfrost dynamics, Annu. Rev. Fluid Mech., 197-215 (2013).
Reyssat et al., Dynamical superhydrophobicity. Faraday Discussions, 146:19-33 (2010).
Reyssat, et al., Bouncing transitions on microtextured materials. Europhysics Letters, 74(2):306-312 (2006).
Roosen et al., Optical levitation by means of two horizontal laser beams: a theoretical and experimental study. Physics Letters A, 59(1):6-8 (1976).
Rothstein, J. P., Slip on superhydrophobic surfaces, ANRV400-FL42-05, ARI, 89-109 (2010).
Rykaczewski et al., Mechanism of Frost Formation of Lubricant-Impregnated Surfaces, Langmuir 2013, 29 5230-5238, 13 pages.
Sekeroglu et al., Transport of a soft cargo on a nanoscale ratchet. Applied Physics Letters, 99(6) (2011).
Smith et al., Droplet Mobility on Lubricant-Impregnated Surfaces, Soft Matter, 2012(9): 1772-1780 (2012).
Smith et al., Liquid-encapsulating surfaces: overcoming the limitations of superhydrophobic surfaces for robust non-wetting and anti-icing surfaces. In Bulletin of the American Physical Society (2011) Abstract Only.
Snoeijer et al., Maximum size of drops levitated by an air cushion. Physical Review E—Statistical, Nonlinear, and Soft Matter Physics, 79(3) (2009).
Song et al., Vitrification and levitation of a liquid droplet on liquid nitrogen, PNAS Early Edition, pp. 1-5 (2010).
Trinh et al., The dynamics of ultrasonically levitated drops in an electric field. Physics of Fluids, 8(1):43-61 (1996).

(56) References Cited

OTHER PUBLICATIONS

Tuteja et al., Designing superoleophobic surfaces. Science, 318(5856):1618-1622 (2007).
Tuteja et al., Robust omniphobic surfaces. Proceedings of the National Academy of Sciences of the United States of America, 105(47):18200-18205 (2008).
Vakarelski et al., Drag reduction by leidenfrost vapor layers. Physical Review Letters, 106(21) (2011).
Vakarelski et al., Stabilization of Leidenfrost vapour layer by textured superhydrophobic surfaces. Nature, 489(7415):274-277 (2012).
Weber et al., Aero-acoustic levitation: A method for containerless liquid-phase processing at high temperatures. Review of Scientific Instruments, 65(2):456-465 (1994).
Weickgenannt et al., Inverse-Leidenfrost phenomenon on nanofiber mats on hot surfaces. Physical Review E—Statistical, Nonlinear, and Soft Matter Physics, 84(3) (2011).
Weilert et al., Magnetic levitation and noncoalescence of liquid helium. Physical Review Letters, 77(23):4840-4843 (1996).
Welter et al., Acoustically levitated droplets—A new tool for micro and trace analysis. Fresenius' Journal of Analytical Chemistry, 357(3):345-350 (1997).
Wenzel, Resistance of Solid Surfaces to Wetting by Water, Industrial & Engineering Chemistry, 28(8): 988-994 (1936).
Written Opinion, PCT/US13/028439, Dec. 5, 2013, 11 pages.
Written Opinion, PCT/US2011/061898, Apr. 24, 2013, 9 pages.
Written Opinion, PCT/US2012/042327, May 16, 2013, 6 pages.
Written Opinion, PCT/US2013/021558, Oct. 11, 2013, 7 pages.
Written Opinion, PCT/US2013/045731, Nov. 12, 2013, 3 pages.
Written Opinion, PCT/US2013/070827, Mar. 27, 2014, 15 pages.
Würger, A., Leidenfrost gas ratchets driven by thermal creep. Physical Review Letters, 107(16) (2011).
Yarin et al., On the acoustic levitation of droplets. Journal of Fluid Mechanics, 356:65-91 (1998).
Yasuda et al., Levitation of metallic melt by using the simultaneous imposition of the alternating and the static magnetic fields. Journal of Crystal Growth, 260(3-4):475-485 (2004).
Yu et al., Containerless solidification of oxide material using an electrostatic levitation furnace in microgravity. Journal of Crystal Growth, 231(4):568-576 (2001).

* cited by examiner

Sour Cream and
Onion Dip 0 sec

13sec 120 sec

Yogurt 0 sec 10 sec 24 sec

Toothpaste 0 sec

2sec 4 sec

Hair gel 0 sec 2 sec 3 sec

SELF-LUBRICATING SURFACES FOR FOOD PACKAGING AND FOOD PROCESSING EQUIPMENT

CROSS-REFERENCE TO RELATED APPLICATION

This application claims priority to and the benefit of, and incorporates herein by reference in its entirety, U.S. Provisional Patent Application No. 61/614,941, filed Mar. 23, 2012, and U.S. Provisional Patent Application No. 61/651,545, filed May 24, 2012.

TECHNICAL FIELD

This invention relates generally to non-wetting and self-lubricating surfaces for food and other consumer product packaging and processing equipment.

BACKGROUND

The advent of micro/nano-engineered surfaces in the last decade has opened up new techniques for enhancing a wide variety of physical phenomena in thermofluids sciences. For example, the use of micro/nano surface textures has provided nonwetting surfaces capable of achieving less viscous drag, reduced adhesion to ice and other materials, self-cleaning, and water repellency. These improvements result generally from diminished contact (i.e., less wetting) between the solid surfaces and adjacent liquids.

There is a need for improved non-wetting and self-lubricating surfaces. A particular need exists for improved non-wetting and self-lubricating surfaces for food packaging and food processing equipment.

SUMMARY OF THE INVENTION

In general, the invention relates to liquid-impregnated surfaces for use in food packaging and food processing equipment. In some embodiments, the surfaces are used in containers or bottles for food products, such as ketchup, mustard, mayonnaise, and other products that are poured, squeezed, or otherwise extracted from the containers or bottles. The surfaces allow the food products to flow easily out of the containers or bottles. The surfaces described herein may also prevent leaching of chemicals from the walls of a food container or food processing equipment into the food, thereby enhancing the health and safety of consumers. In one embodiment, the surfaces provide barriers to diffusion of water or oxygen, and/or protect the contained material (e.g., a food product) from ultraviolet radiation. Cost-efficient methods for fabricating these surfaces are described herein.

Containers having liquid encapsulated coatings described herein demonstrate surprisingly effective food-emptying properties. The embodiments described herein are particularly useful for use with containers or processing equipment for foods or other consumer products that notoriously stick to the containers or processing equipment (e.g., containers and equipment that come into contact with such consumer products). For example, it has been found that the embodiments described herein are useful for use with consumer products that are non-Newtonian fluids, particularly Bingham plastics and thixotropic fluids. Other fluids for which embodiments described herein work well include high viscosity fluids, high zero shear rate viscosity fluids (shear-thinning fluids), shear-thickening fluids, and fluids with high surface tension. Here, fluid can mean a solid or liquid (a substance that flows).

Bingham plastics (e.g., yield stress fluids) are fluids that require a finite yield stress before beginning to flow. These are more difficult to squeeze or pour out of a bottle or other container. Examples of Bingham plastics include mayonnaise, mustard, chocolate, tomato paste, and toothpaste. Typically, Bingham plastics will not flow out of containers, even if held upside down (e.g., toothpaste will not flow out of the tube, even if held upside down). It has been found that embodiments described herein work well for use with Bingham plastics.

Thixotropic fluids are fluids with viscosities that depend on the time history of shear (and whose viscosities decrease as shear is continually applied). In other words, thixotropic fluids must be agitated over time to begin to thin. Ketchup is an example of a thixotropic fluid, as is yogurt. Embodiments described herein are found to work well with thixotropic fluids.

Embodiments described herein also work well with high viscosity fluids (e.g., fluids with greater than 100 cP, greater than 500 cP, greater than 1000 cP, greater than 3000 cP, or greater than 5000 cP, for example). Embodiments also work well with high zero shear rate viscosity materials (e.g., shear-thinning fluids) above 100 cP. Embodiments also work well with high surface tension substances, which are relevant where substances are contained in very small bottles or tubes.

In one aspect, the invention is directed to an article including a liquid-impregnated surface, said surface including a matrix of solid features spaced sufficiently close to stably contain a liquid therebetween and/or therewithin, wherein the features and liquid are non-toxic and/or edible. In certain embodiments, the liquid is stably contained within the matrix regardless of orientation of the article and/or under normal shipping and/or handling conditions. In certain embodiments, the article is a container of a consumer product. In certain embodiments, the solid features include particles. In certain embodiments, the particles have an average characteristic dimension in a range, for example, of about 5 microns to about 500 microns, or about 5 microns to about 200 microns, or about 10 microns to about 50 microns. In certain embodiments, the characteristic dimension is a diameter (e.g., for roughly spherical particles), a length (e.g., for roughly rod-shaped particles), a thickness, a depth, or a height. In certain embodiments, the particles include insoluble fibers, purified wood cellulose, micro-crystalline cellulose, oat bran fiber, kaolinite (clay mineral), Japan wax (obtained from berries), pulp (spongy part of plant stems), ferric oxide, iron oxide, sodium formate, sodium oleate, sodium palmitate, sodium sulfate, wax, carnauba wax, beeswax, candelilla wax, zein (from corn), dextrin, cellulose ether, Hydroxyethyl cellulose, Hydroxypropyl cellulose (HPC), Hydroxyethyl methyl cellulose, Hydroxypropyl methyl cellulose (HPMC), and/or Ethyl hydroxyethyl cellulose. In certain embodiments, the particles include a wax. In certain embodiments, the particles are randomly spaced. In certain embodiments, the particles are arranged with average spacing of about 1 micron to about 500 microns, or from about 5 microns to about 200 microns, or from about 10 microns to about 30 microns between adjacent particles or clusters of particles. In certain embodiments, the particles are spray-deposited (e.g., deposited by aerosol or other spray mechanism). In certain embodiments, the consumer product comprises at least one member selected from the group consisting of ketchup, catsup, mustard, mayonnaise, syrup, honey, jelly, peanut butter, butter, chocolate syrup, shortening, butter, margarine, oleo, grease, dip, yogurt, sour cream, cosmetics, shampoo, lotion, hair gel, and toothpaste. In certain embodiments, a food product is sticky food (e.g., candy, chocolate syrup, mash, yeast mash, beer mash, taffy), food oil, fish oil, marshmallow, dough, batter, baked goods, chewing gum, bubble gum, butter, cheese, cream, cream cheese, mustard, yogurt, sour cream, curry, sauce, ajvar, currywurst sauce, salsa lizano, chutney, pebre, fish sauce, tzatziki, sriracha sauce, vegemite, chimichurri, HP sauce/brown sauce, harissa, kochujang, hoisan sauce, kim chi, cholula hot sauce, tartar sauce, tahini, hummus, shichimi, ketchup, Pasta sauce, Alfredo sauce, Spaghetti sauce, icing, dessert toppings, or whipped cream. In certain embodiments, the container of the consumer product is shelf-stable when filled with the consumer product. In certain embodiments, the consumer product has a viscosity of at least about 100 cP at room temperature. In certain embodiments, the consumer product has a viscosity of at least about 1000 cP at room temperature. In certain embodiments, the consumer product is a non-Newtonian material. In certain embodiments, the consumer product comprises a Bingham plastic, a thixotropic fluid, and/or a shear-thickening substance. In certain embodiments, the liquid includes a food additive (e.g., ethyl oleate), fatty acids, proteins, and/or a vegetable oil (e.g., olive oil, light olive oil, corn oil, soybean oil, rapeseed oil, linseed oil, grapeseed oil, flaxseed oil, canola oil, peanut oil, safflower oil, sunflower oil). In certain embodiments, the article is a component of consumer product processing equipment. In certain embodiments, the article is a component of food processing equipment that comes into contact with food. In certain embodiments, the liquid-impregnated surface has solid-to-liquid ratio less than about 50 percent, or less than about 25 percent, or less than about 15 percent.

In another aspect, the invention is directed to a method of manufacturing a container of a consumer product, the method including the steps of: providing a substrate; applying a texture to the substrate, the texture comprising a matrix of solid features spaced sufficiently close to stably contain a liquid therebetween and/or therewithin (e.g., for example, stably contained when the container is in any orientation, or undergoing normal shipping and/or handling conditions throughout the useful lifetime of the container); and impregnating the matrix of solid features with the liquid, wherein the solid features and the liquid are non-toxic and/or edible. In certain embodiments, the solid features are particles. In certain embodiments, the applying step includes spraying a mixture of a solid and a solvent onto the textured substrate. In certain embodiments, the solid insoluble fibers, purified wood cellulose, micro-crystalline cellulose, oat bran fiber, kaolinite (clay mineral), Japan wax (obtained from berries), pulp (spongy part of plant stems), ferric oxide, iron oxide, sodium formate, sodium oleate, sodium palmitate, sodium sulfate, wax, carnauba wax, beeswax, candelilla wax, zein (from corn), dextrin, cellulose ether, Hydroxyethyl cellulose, Hydroxypropyl cellulose (HPC), Hydroxyethyl methyl cellulose, Hydroxypropyl methyl cellulose (HPMC), and/or Ethyl hydroxyethyl cellulose. In certain embodiments, the method includes the step of allowing the solvent to evaporate following the spraying of the mixture onto the textured substrate and before the impregnating step. In certain embodiments, the method includes the step of contacting the impregnated matrix of features with a consumer product. In certain embodiments, the consumer product is ketchup, catsup, mustard, mayonnaise, syrup, honey, jelly, peanut butter, butter, chocolate syrup, shortening, butter, margarine, oleo, grease, dip, yogurt, sour cream, cosmetics, shampoo, lotion, hair gel, or toothpaste. In certain embodiments, In certain embodiments, the consumer product is a sticky food (e.g., candy, chocolate syrup, mash, yeast mash, beer mash, taffy), food oil, fish oil, marshmallow, dough, batter, baked goods, chewing gum, bubble gum, butter, cheese, cream, cream cheese, mustard, yogurt, sour cream, curry, sauce, ajvar, currywurst sauce, salsa lizano, chutney, pebre, fish sauce, tzatziki, sriracha sauce, vegemite, chimichurri, HP sauce/brown sauce, harissa, kochujang, hoisan sauce, kim chi, cholula hot sauce, tartar sauce, tahini, hummus, shichimi, ketchup, Pasta sauce, Alfredo sauce, Spaghetti sauce, icing, dessert toppings, or whipped cream. In certain embodiments, the liquid includes a food additive (e.g., ethyl oleate), fatty acids, proteins, and/or vegetable oil (e.g., olive oil, light olive oil, corn oil, soybean oil, rapeseed oil, linseed oil, grapeseed oil, flaxseed oil, canola oil, peanut oil, safflower oil, and/or sunflower oil). In certain embodiments, the step of applying the texture to the substrate includes: exposing the substrate to a solvent (e.g., solvent-induced crystallization), extruding or blow-molding a mixture of materials, roughening the substrate with mechanical action (e.g., tumbling with an abrasive), spray-coating, polymer spinning, depositing particles from solution (e.g., layer-by-layer deposition and/or evaporating away liquid from a liquid and particle suspension), extruding or blow-molding a foam or foam-forming material (e.g., a polyurethane foam), depositing a polymer from a solution, extruding or blow-molding a material that expands upon cooling to leave a wrinkled or textured surface, applying a layer of material onto a surface that is under tension or compression, performing non-solvent induced phase separation of a polymer to obtain a porous structure, performing micro-contact printing, performing laser rastering, performing nucleation of the solid texture out of vapor (e.g., desublimation), performing anodization, milling, machining, knurling, e-beam milling, performing thermal or chemical oxidation, and/or performing chemical vapor deposition. In certain embodiments, applying the texture to the substrate includes spraying a mixture of edible particles onto the substrate. In certain embodiments, impregnating the matrix of features with the liquid includes: spraying the encapsulating liquid onto the matrix of features, brushing the liquid onto the matrix of features, submerging the matrix of features in the liquid, spinning the matrix of features, condensing the liquid onto the matrix of features, depositing a solution comprising the liquid and one or more volatile liquids, and/or spreading the liquid over the surface with a second immiscible liquid. In certain embodiments, the liquid is mixed with a solvent and then sprayed, because the solvent will reduce the liquid viscosity, allowing it to spray more easily and more uniformly. Then, the solvent will dry out of the coating. In certain embodiments, the method further includes chemically modifying the substrate prior to applying the texture to the substrate and/or chemically modifying the solid features of the texture. For example, the method may include chemically modifying with a material having contact angle with water of greater than 70 degrees (e.g., hydrophobic material). The modification may be conducted, for example, after the texture is applied, or may be applied to particles prior to their application to the substrate. In certain embodiments, impregnating the matrix of features includes removing excess liquid from the matrix of features. In certain embodiments, removing the excess liquid includes: using a second immiscible liquid to carry away the excess liquid, using mechanical action to remove the excess liquid, absorbing the excess liquid using a porous material, and/or draining the excess liquid off of the matrix of features using gravity or centrifugal forces.

Elements of embodiments described with respect to a given aspect of the invention may be used in various embodiments of another aspect of the invention. For example, it is contemplated that features of dependent claims depending from one independent claim can be used in apparatus and/or methods of any of the other independent claims.

BRIEF DESCRIPTION OF THE DRAWINGS

The objects and features of the invention can be better understood with reference to the drawings described below, and the claims.

DESCRIPTION

It is contemplated that articles, apparatus, methods, and processes of the claimed invention encompass variations and adaptations developed using information from the embodiments described herein. Adaptation and/or modification of the articles, apparatus, methods, and processes described herein may be performed by those of ordinary skill in the relevant art.

Throughout the description, where articles and apparatus are described as having, including, or comprising specific components, or where processes and methods are described as having, including, or comprising specific steps, it is contemplated that, additionally, there are articles and apparatus of the present invention that consist essentially of, or consist of, the recited components, and that there are processes and methods according to the present invention that consist essentially of, or consist of, the recited processing steps.

It should be understood that the order of steps or order for performing certain actions is immaterial so long as the invention remains operable. Moreover, two or more steps or actions may be conducted simultaneously.

The mention herein of any publication, for example, in the Background section, is not an admission that the publication serves as prior art with respect to any of the claims presented herein. The Background section is presented for purposes of clarity and is not meant as a description of prior art with respect to any claim.

Liquid-impregnated surfaces are described in U.S. patent application Ser. No. 13/302,356, titled "Liquid-Impregnated Surfaces, Methods of Making, and Devices Incorporating the Same," filed Nov. 22, 2011, the disclosure of which is hereby incorporated by reference herein in its entirety.

Figure 1A:
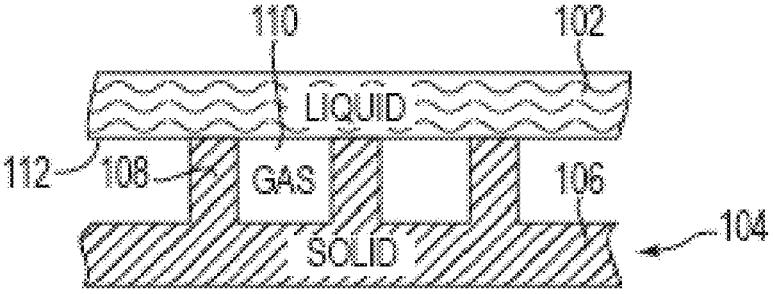
FIG. 1*a* is a schematic cross-sectional view of a liquid contacting a non-wetting surface, in accordance with certain embodiments of the invention.

FIG. 1*a* is a schematic cross-sectional view of a liquid 102 in contact with a traditional or previous non-wetting surface 104 (i.e., a gas impregnating surface), in accordance with some embodiments of the invention. The surface 104 includes a solid 106 having a surface texture defined by features 108. In some embodiments, a solid 106 is defined by features 108.

The regions between the features 108 are occupied by a gas 110, such as air. As depicted, while the liquid 102 is able to contact the tops of the features 108, a gas-liquid interface 112 prevents the liquid 102 from wetting the entire surface 104.

Figure 1B:
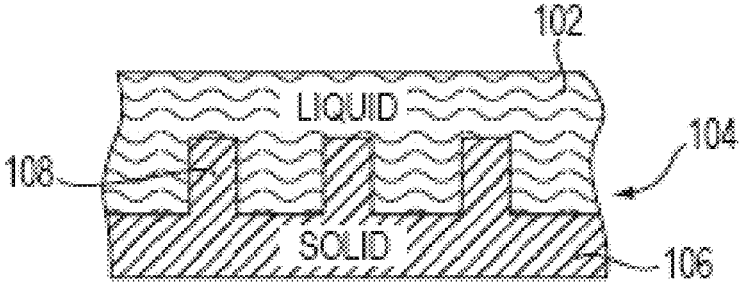
FIG. 1*b* is a schematic cross-sectional view of a liquid that has impaled a non-wetting surface, in accordance with certain embodiments of the invention.

Referring to FIG. 1*b*, in certain instances, the liquid 102 may displace the impregnating gas and become impaled within the features 108 of the solid 106. Impalement may occur, for example, when a liquid droplet impinges the surface 104 at high velocity. When impalement occurs, the gas occupying the regions between the features 108 is replaced with the liquid 102, either partially or completely, and the surface 104 may lose its nonwetting capabilities.

Figure 1C:
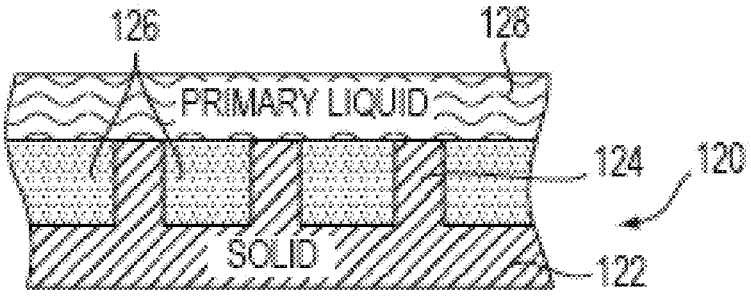
FIG. 1*c* is a schematic cross-sectional view of a liquid in contact with a liquid-impregnated surface, in accordance with certain embodiments of the invention.

Referring to FIG. 1*c*, in certain embodiments, a non-wetting, liquid-impregnated surface 120 is provided that includes a solid 122 having textures (e.g., features 124) that are impregnated with an impregnating liquid 126, rather than a gas. In various embodiments, a coating on the surface 104 includes the solid 106 and the impregnating liquid 126.

In the depicted embodiment, a contacting liquid 128 in contact with the surface, rests on the features 124 (or other texture) of the surface 120. In the regions between the features 124, the contacting liquid 128 is supported by the impregnating liquid 126. In certain embodiments, the contacting liquid 128 is immiscible with the impregnating liquid 126. For example, the contacting liquid 128 may be water and the impregnating liquid 126 may be oil.

In some embodiments, micro-scale features are used. In some embodiments, a micro-scale feature is a particle. Particles can be randomly or uniformly dispersed on a surface. Characteristic spacing between particles can be about 200 μm, about 100 μm, about 90 μm, about 80 μm, about 70 μm, about 60 μm, about 50 μm, about 40 μm, about 30 μm, about 20 μm, about 10 μm, about 5 μm or 1 μm. In some embodiments, characteristic spacing between particles is in a range of 100 μm-1 μm, 50 μm-20 μm, or 40 μm-30 μm. In some embodiments, characteristic spacing between particles is in a range of 100 μm-80 μm, 80 μm-50 μm, 50 μm-30 μm or 30 μm-10 μm. In some embodiments, characteristic spacing between particles is in a range of any two values above.

Particles can have an average dimension of about 200 μm, about 100 μm, about 90 μm, about 80, about 70 μm, about 60 μm, about 50 μm, about 40 μm, about 30 μm, about 20 μm, about 10 μm, about 5 μm or 1 μm. In some embodiments, an average dimension of particles is in a range of 100 μm-1 μm, 50 μm-10 μm, or 30 μm-20 μm. In some embodiments, an average dimension of particles is in a range of 100 μm-80 μm, 80 μm-50 μm, 50 μm-30 μm or 30 μm-10 μm. In some embodiments, an average dimension of particles is in a range of any two values above.

In some embodiments, particles are porous. Characteristic pore size (e.g., pore widths or lengths) of particles can be about 5000 nm, about 3000 nm, about 2000 nm, about 1000 nm, about 500 nm, about 400 nm, about 300 nm, about 200 nm, about 100 nm, about 80 nm, about 50, about 10 nm. In some embodiments, characteristic pore size is in a range of 200 nm-2 μm or 100 nm-1 μm. In some embodiments, characteristic pore size is in a range of any two values above.

The articles and methods described herein relate to liquid-impregnated surfaces that are particularly valuable as interior bottle coatings, and valuable to food processing equipment. The articles and methods have applications across a wide-range of food packaging and process equipment. For example, the articles may be used as bottle coatings to improve the flow of the material out of the bottle, or flow over or through food processing equipment. In certain embodiments, the surfaces or coatings described herein prevent leaching of chemicals from the walls of a bottle or food processing equipment into the food, thereby enhancing the health and safety of consumers. These surfaces and coatings may also provide barriers to diffusion of water or oxygen, and/or protect the contained material (e.g., a food product) from ultraviolet radiation. In certain embodiments, the surfaces or coatings described herein can be used with food bins/totes/bags and/or conduits/channels in industrial transportation setting as well as other food processing equipments.

In certain embodiments, the articles described here are used to contain a consumer product. For example, handling of sticky foods, such as chocolate syrup, in coated containers leaves significant amount of food left stuck to container walls. Coating container walls with liquid encapsulated texture can not only reduce food wastage but also lead to easy handling.

In certain embodiments, the articles described here are used to contain a food product. The food product may be, for example, ketchup, mustard, mayonnaise, butter, peanut butter, jelly, jam, ice cream, dough, gum, chocolate syrup, yogurt, cheese, sour cream, sauce, icing, curry, food oil or any other food product that is provided or stored in a container. A food product can also be dog food or cat food. The articles may also be used to contain household products and health-care products, such as cosmetics, lotion, toothpaste, shampoo, hair gel, medical fluids (e.g., antibacterial ointments or creams), and other related products or chemicals.

In some embodiments, a consumer product in contact with an article has a viscosity of at least 100 cP (e.g., at room temperature). In some embodiments, a consumer product has a viscosity of at least 500 cP, 1000 cP, 2000 cP, 3000 cP or 5000 cP. In some embodiments, a consumer product has a viscosity in a range of 100-500 cP, 500-1000 cP, or 1000-2000 cP. In some embodiments, a consumer product has a viscosity in a range of any two values above.

In various embodiments, a liquid-impregnated surface includes a textured, porous, or roughened substrate that is encapsulated or impregnated by a non-toxic and/or an edible liquid. The edible liquid may be, for example, a food additive (e.g., ethyl oleate), fatty acids, proteins, and/or or a vegetable oil (e.g., olive oil, light olive oil, corn oil, soybean oil, rapeseed oil, linseed oil, grapeseed oil, flaxseed oil, canola oil, peanut oil, safflower oil, sunflower oil). In one embodiment, the edible liquid is any liquid approved for consumption by the U.S. Food and Drug Administration (FDA). The substrate is preferably listed in the FDA's list of approved food contact substances, available at www.accessdata.fda.gov.

In certain embodiments, a textured material on the inside of an article (e.g., a bottle or other food container) is integral to the bottle itself. For example, the textures of a polycarbonate bottle may be made of polycarbonate.

In various embodiments, the solid 122 comprises a matrix of solid features. The solid 122 or a matrix of solid features can include a non-toxic and/or edible material. In some embodiments, surfaces textures of a liquid-encapsulated include solid, edible materials. For example, the surfaces textures may be formed from a collection or coating of edible solid particles. Examples of solid, non-toxic and/or edible materials include insoluble fibers (e.g., purified wood cellulose, micro-crystalline cellulose, and/or oat bran fiber), wax (e.g., carnauba wax), and cellulose ethers (e.g., Hydroxyethyl cellulose, Hydroxypropyl cellulose (HPC), Hydroxyethyl methyl cellulose, Hydroxypropyl methyl cellulose (HPMC), and/or Ethyl hydroxyethyl cellulose).

In various embodiments, a method is provided for imparting a surface texture (e.g., roughness and/or porosity) to the solid substrate. In one embodiment, the texture is imparted by exposing the substrate (e.g., polycarbonate) to a solvent (e.g., acetone). For example, the solvent may impart texture by inducing crystallization (e.g., polycarbonate may recrystallize when exposed to acetone).

In various embodiments, the texture is imparted through extrusion or blow-molding of a mixture of materials (e.g., a continuous polymer blend, or mixture of a polymer and particles). One of the materials may be subsequently dissolved, etched, melted, or evaporated away, leaving a textured, porous, and/or rough surface behind. In one embodiment, one of the materials is in the form of particles that are larger than an average thickness of the coating. Advantageously, packaging for food products (e.g., ketchup bottles) is currently produced using extrusion or blow-molding. Methods described herein may therefore be performed using existing equipment, with little added expense.

In certain embodiments, the texture is imparted by mechanical roughening (e.g., tumbling with an abrasive), spray-coating or polymer spinning, deposition of particles from solution (e.g., layer-by-layer deposition, evaporating away liquid from a liquid+particle suspension), and/or extrusion or blow-molding of a foam, or foam-forming material (for example a polyurethane foam). Other possible methods for imparting the texture include: deposition of a polymer from a solution (e.g., the polymer forms a rough, porous, or textured surface behind); extrusion or blow-molding of a material that expands upon cooling, leaving a wrinkled surface; and application of a layer of a material onto a surface that is under tension or compression, and subsequently relaxing the tension or compression of surface beneath, resulting in a textured surface.

In one embodiment, the texture is imparted through non-solvent induced phase separation of a polymer, resulting in a sponge-like porous structure. For example, a solution of polysulfone, poly(vinylpyrrolidone), and DMAc may be cast onto a substrate and then immersed in a bath of water. Upon immersion in water, the solvent and non-solvent exchange and the polysulfone precipitates and hardens.

In some embodiments, a liquid-impregnated surface includes the impregnating liquid and portions of the solid material that extend or poke through the impregnating liquid (e.g., to contact an adjacent air phase). To achieve optimal non-wetting and self-lubricating performance, it is generally desirable to minimize the amount of solid material that extends through (i.e., is not covered by) the impregnating liquid. For example, a ratio of the solid material to the impregnating liquid at the surface is preferably less than about 15 percent, or more preferably less than about 5 percent. In some embodiments, a ratio of the solid material to the impregnating liquid is less than 50 percent, 45 percent, 40 percent, 35 percent, 30 percent, 25 percent, 20 percent, 15 percent, 10 percent, 5 percent, or 2 percent. In some embodiments, a ratio of the solid material to the impregnating liquid is in a range of 50-5 percent, 30-10 percent, 20-15 percent or any two values above. In certain embodiments, a low ratio is achieved using surface textures that are pointy or round. By contrast, surface textures that are flat may result in higher ratios, with too much solid material exposed at the surface.

In various embodiments, a method is provided for impregnating the surface texture with an impregnating liquid. For example, the impregnating liquid may be sprayed or brushed onto the texture (e.g., a texture on an inner surface of a bottle). In one embodiment, the impregnating liquid is applied to the textured surface by filling or partially filling a container that includes the textured surface. The excess impregnating liquid is then removed from the container. In various embodiments, the excess impregnating liquid is removed by adding a wash liquid (e.g., water) to the container to collect or extract the excess liquid from the container. Additional methods for adding the impregnating liquid include spinning the container or surface in contact with the liquid (e.g., a spin coating process), and condensing the impregnating liquid onto the container or surface. In various embodiments, the impregnating liquid is applied by depositing a solution with the impregnating liquid and one or more volatile liquids (e.g., via any of the previously described methods) and evaporating away the one or more volatile liquids.

In certain embodiments, the impregnating liquid is applied using a spreading liquid that spreads or pushes the impregnating liquid along the surface. For example, the impregnating liquid (e.g., ethyl oleate) and spreading liquid (e.g., water) may be combined in a container and agitated or stirred. The fluid flow within the container may distribute the impregnating liquid around the container as it impregnates the surface textures.

With any of these methods, the excess impregnating liquid may be mechanically removed (e.g., pushed off the surface with a solid object or fluid), absorbed off of the surface using another porous material, or removed via gravity or centrifugal forces. The processing materials are preferably FDA approved for consumption in small quantities.

EXPERIMENTAL EXAMPLES

Creating Matrix of Solid Features on Interior Bottle Surfaces:

In these experiments, 200-proof pure ethanol (KOPTEC), powdered carnauba wax (McMaster-Carr) and aerosol carnauba wax spray (PPE, #CW-165), which contains trichloroethylene, propane and carnauba wax, were used. The sonicator was from Branson, Model 2510. The advanced hot plate stirrer was from VWR, Model 97042-642. The airbrush was from Badger Air-Brush Co., Model Badger 150.

Figure 2:
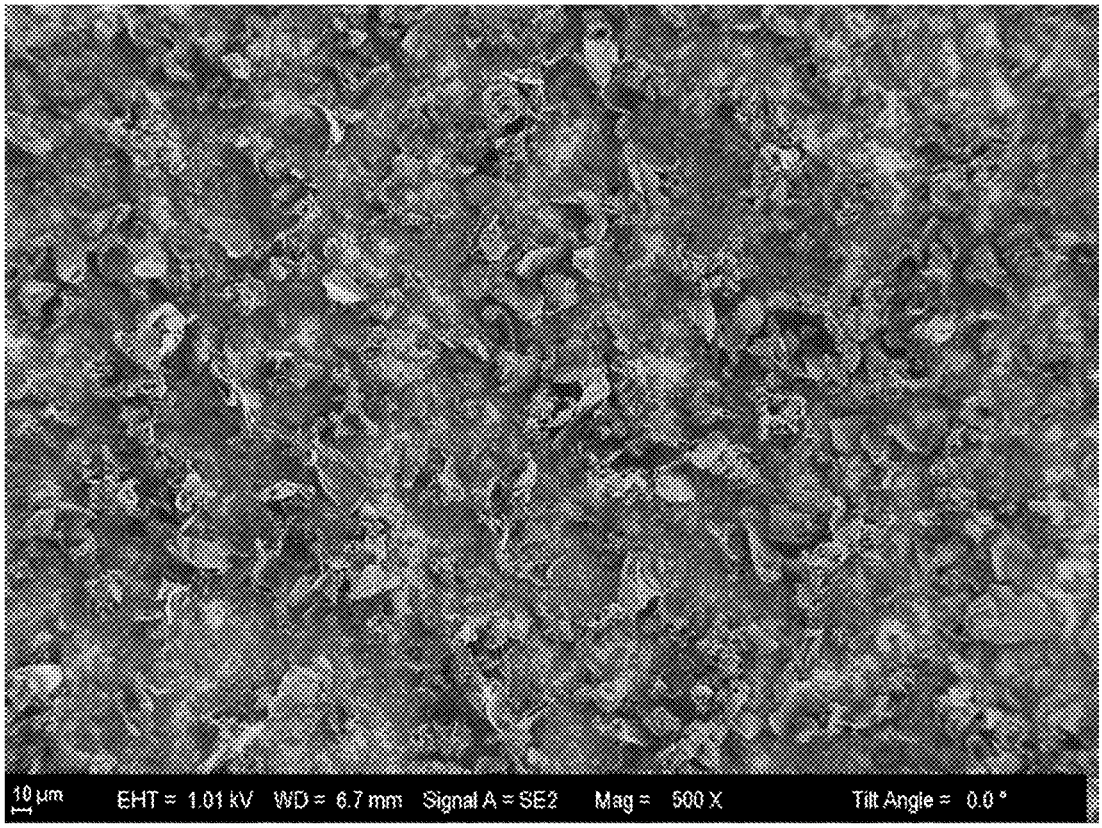
FIG. 2 is an SEM (Scanning Electron Microscope) image of a typical rough surface obtained by spraying an emulsion of ethanol and carnauba wax onto an aluminum substrate. After drying, the particles display characteristic sizes of 10 μm-50 μm and arrange into sparse clusters with characteristic spacings of 20 μm-50 μm between adjacent particles. These particles constitute the first length scale of the hierarchical texture.
Figure 3:
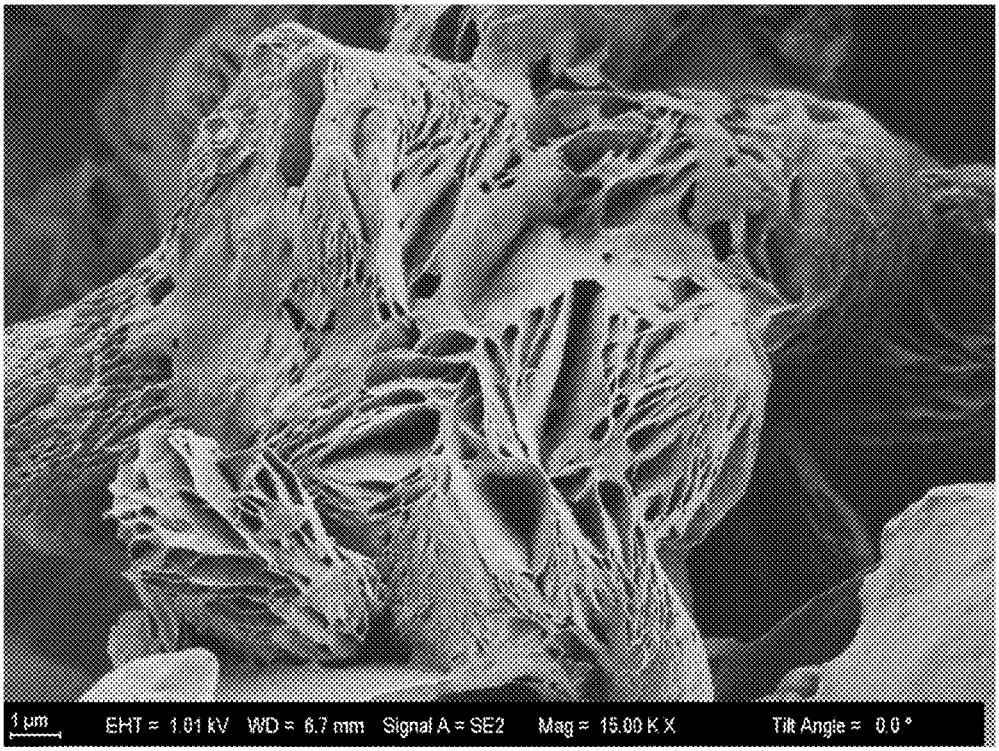
FIG. 3 is an SEM (Scanning Electron Microscope) image of exemplary detail of a particle of carnauba wax obtained from a boiled ethanol-wax emulsion and sprayed onto an aluminum substrate. After drying, the wax particle exhibits porous sub-micron roughness features with characteristic pore widths of 100 nm-1 μm and pore lengths of 200 nm-2 μm. These porous roughness features constitute the second length scale of the hierarchical texture.

A first surface with a matrix of solid features was prepared by procedure 1 described here. A mixture was made by heating 40 ml ethanol to 85° C., slowly adding 0.4 g carnauba wax powder, boiling the mixture of ethanol and was for 5 min, followed by allowing the mixture to cool while being sonicated from 5 min. The resulting mixture was sprayed onto a substrate with an airbrush at 50 psi, and then allowing the substrate to dry at ambient temperature and humidity for 1 min. SEM images are shown in FIGS. 2 and 3.

Figure 4:
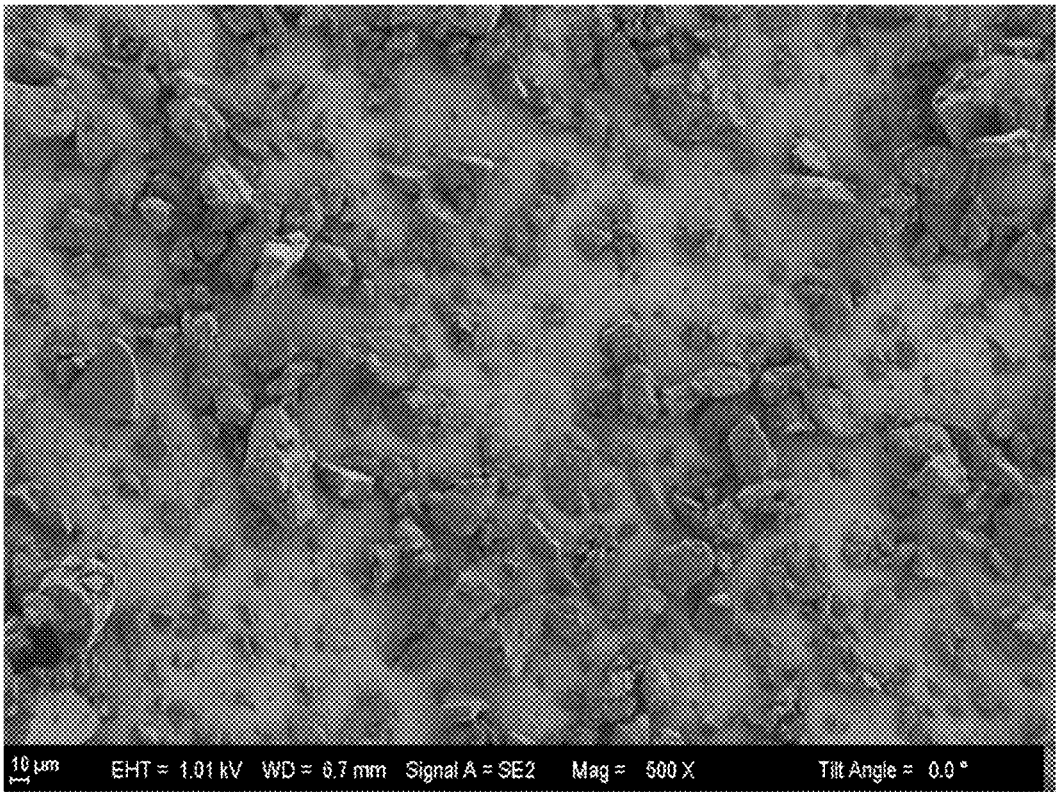
FIG. 4 is an SEM (Scanning Electron Microscope) image of a typical rough surface obtained by spraying an mixture of ethanol and carnauba wax particles onto an aluminum substrate. After drying, the particles display characteristic sizes of 10 μm-50 μm and arrange into dense clusters with characteristic spacings of 10 μm-30 μm between adjacent particles. These particles constitute the first length scale of the hierarchical texture.
Figure 5:
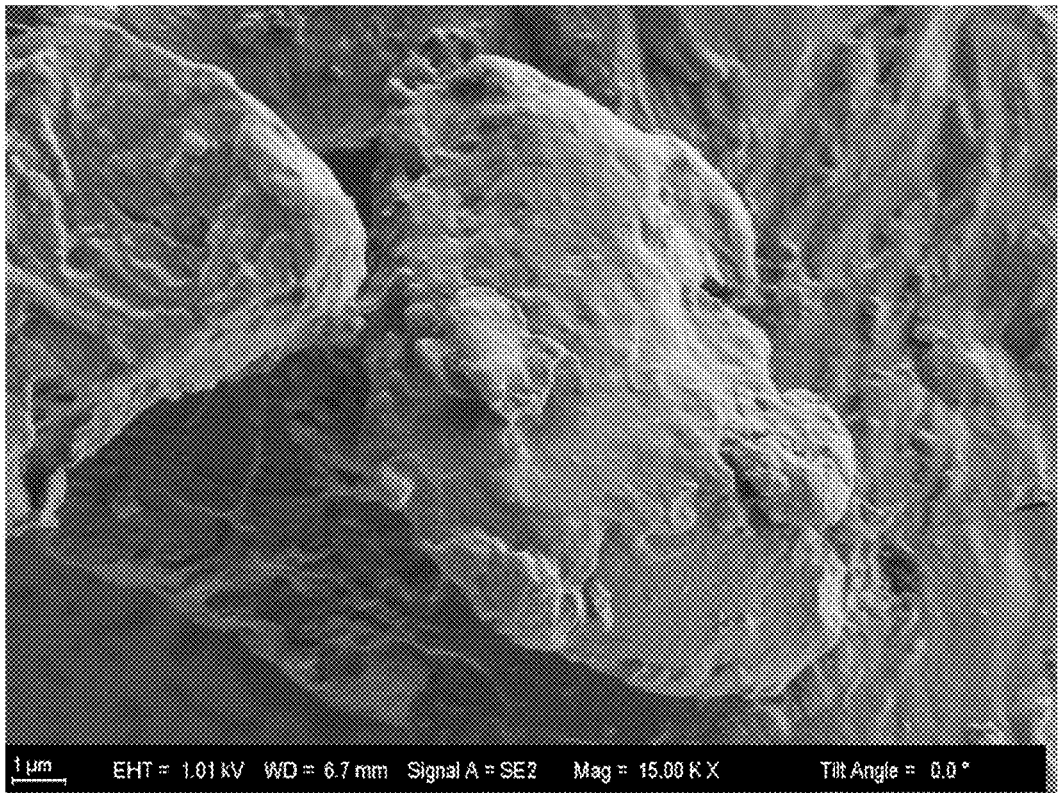
FIG. 5 is an SEM (Scanning Electron Microscope) image of exemplary detail of a particle of carnauba wax obtained from a wax particle-ethanol mixture sprayed onto an aluminum substrate. After drying, the wax particle exhibits low aspect ratio sub-micron roughness features with heights of 100 nm. These porous roughness features constitute the second length scale of the hierarchical texture.

A second surface was prepared by procedure 2 described here. A mixture was made by adding 4 g powdered carnauba wax to 40 ml ethanol and vigorously stirring. The resulting mixture was sprayed onto a substrate with an airbrush at 50 psi for 2 sec at a distance of 4 inches from the surface, and then allowing the substrate to dry at ambient temperature and humidity for 1 min. SEM images are shown in FIGS. 4 and 5.

Figure 6:
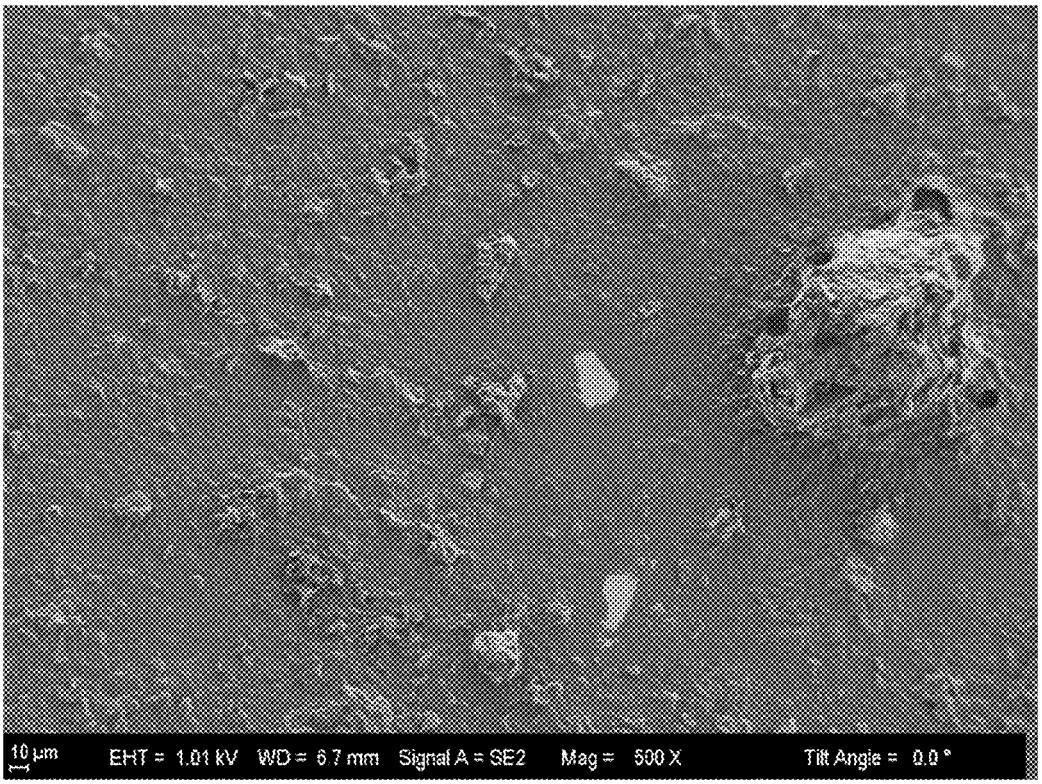
FIG. 6 is an SEM (Scanning Electron Microscope) image of a typical rough surface obtained by spraying an emulsion of a solvent solution and carnauba wax onto an aluminum substrate. After drying, the particles display characteristic sizes of 10 μm-10 μm with and average characteristic size of 30 μm. They are sparsely spaces with characteristic spacings of 50 μm-100 μm between adjacent particles. These particles constitute the first length scale of the hierarchical texture.
Figure 7:
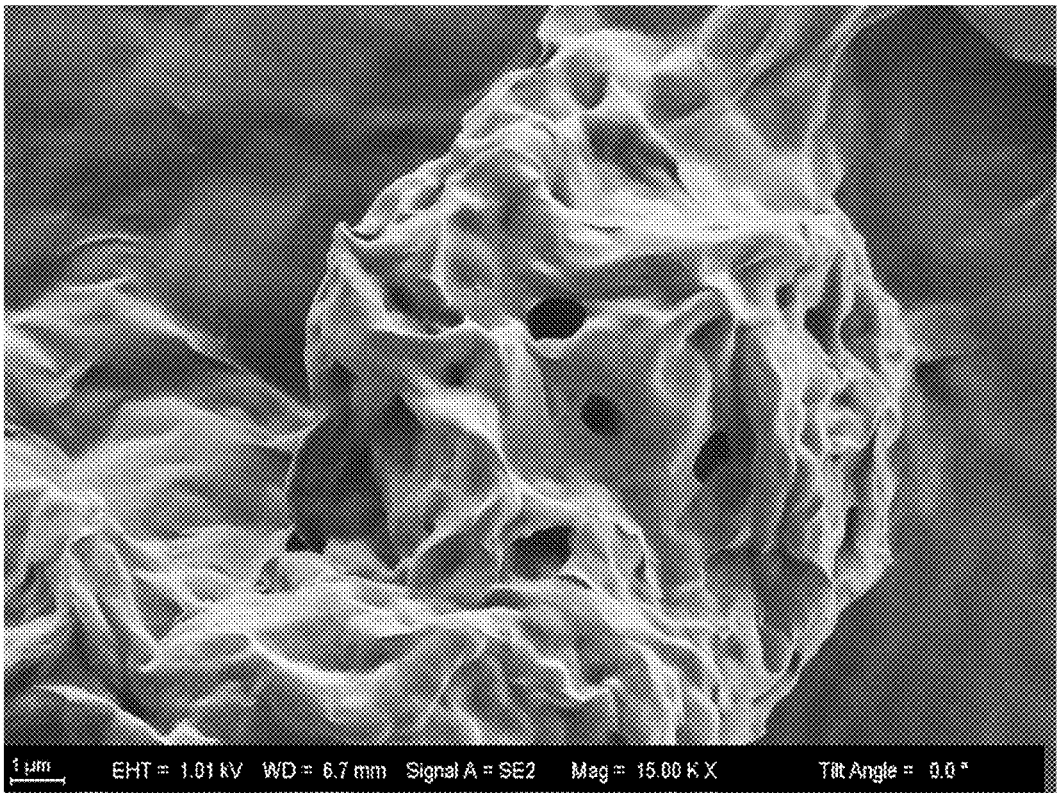
FIG. 7 is an SEM (Scanning Electron Microscope) image of exemplary detail of a particle of carnauba wax obtained from a solvent-wax emulsion and sprayed onto an aluminum substrate. After drying, the wax particle exhibits sub-micron roughness features with characteristic widths of pore widths of 200 nm and pore lengths of 200 nm-2 μm. These porous roughness features constitute the second length scale of the hierarchical texture.
Figure 8:
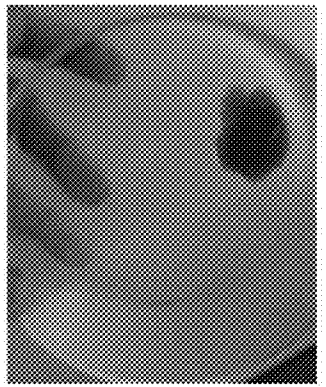
FIGS. 8 through 13 include a sequence of images of a spot of ketchup on a liquid-impregnated surface, in accordance with an illustrative embodiment of the invention.
Figure 9:
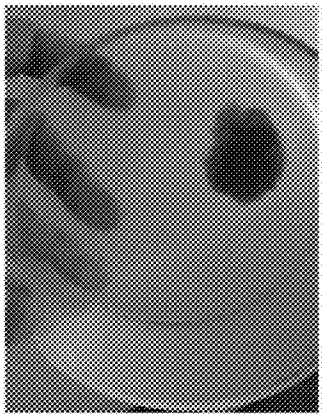
Figure 10:
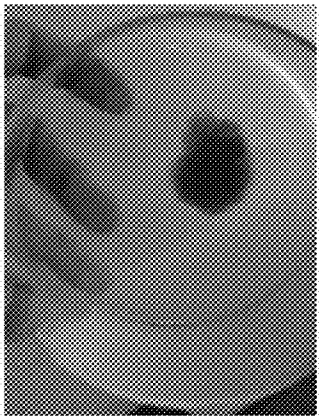
Figure 11:
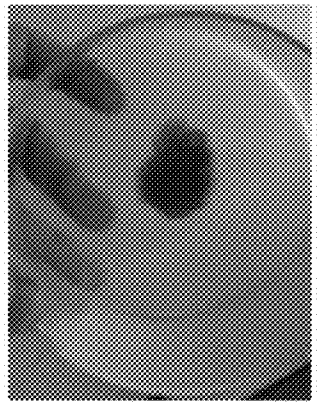
Figure 12:
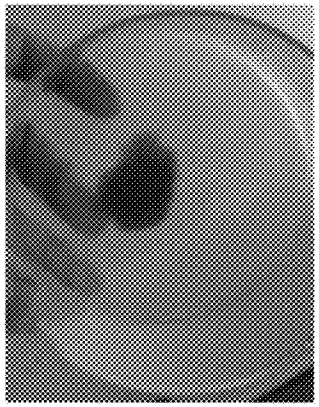
Figure 13:
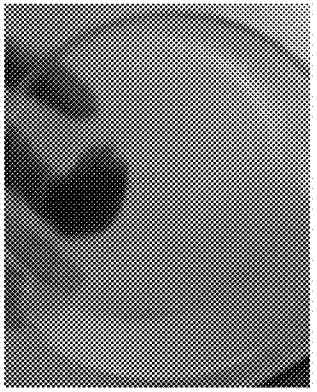

A third surface was prepared by procedure 3 described here. An aerosol wax was sprayed onto a substrate at a distance of 10 inches for 3 sec. We moved the spray nozzle such that spray residence time was no longer than 0.5 sec/unit area, and then allowed the substrate to dry at ambient temperature and humidity for 1 min. SEM images are shown in FIGS. 6 and 7.

Impregnating a Wax Coating:

A quantity of 5 to 10 mL of ethyl oleate (sigma Aldrich) or vegetable oil was swirled around in the bottles until the entire wax-covered surface prepared by procedure 3 described above became transparent. Such a coating time is chosen so that cloudy (not patchy) coating forms over the whole surface. In some embodiments, a formed coating has a thickness in a range of 10-50 microns.

The excess oil was removed by 2 different methods in the experiments. They were either drained by placing them upside down for about 5 minutes, or drained by adding about 50 mL of water to the bottle and shaking it for 5-10 seconds to entrain most of the excess oil into the water. The water/oil emulsion was then dumped out. In general, after draining, the coating appears clear. When it is over-drained it usually appears cloudy.

FIGS. 8 through 13 include a sequence of images of a spot of ketchup on a liquid-impregnated surface, in accordance with an illustrative embodiment of the invention. As depicted, the spot of ketchup was able to slide along the liquid-impregnated surface due to a slight tilting (e.g., 5 to 10 degrees) of the surface. The ketchup moved along the surface as a substantially rigid body, without leaving any ketchup residue along its path. The elapsed time from FIG. 8 to FIG. 13 was about 1 second.

Bottle-Emptying Experiments:

Unless otherwise specified, bottle-emptying experiments were conducted within about 30 minutes after draining excess oil. Coated and uncoated bottles of the same type with an equal amount of the same condiment type. They were then flipped upside down. Plastic/glass bottles were then repeatedly squeezed/pumped until more than 90% of the materials were removed, and then shaken until only small drops of the material were coming out of the uncoated bottles. The coated and uncoated bottles were then weighed, then rinsed, then weighed again, to determine the amount of food left in the bottles after the experiment.

Ketchup

Figure 14:
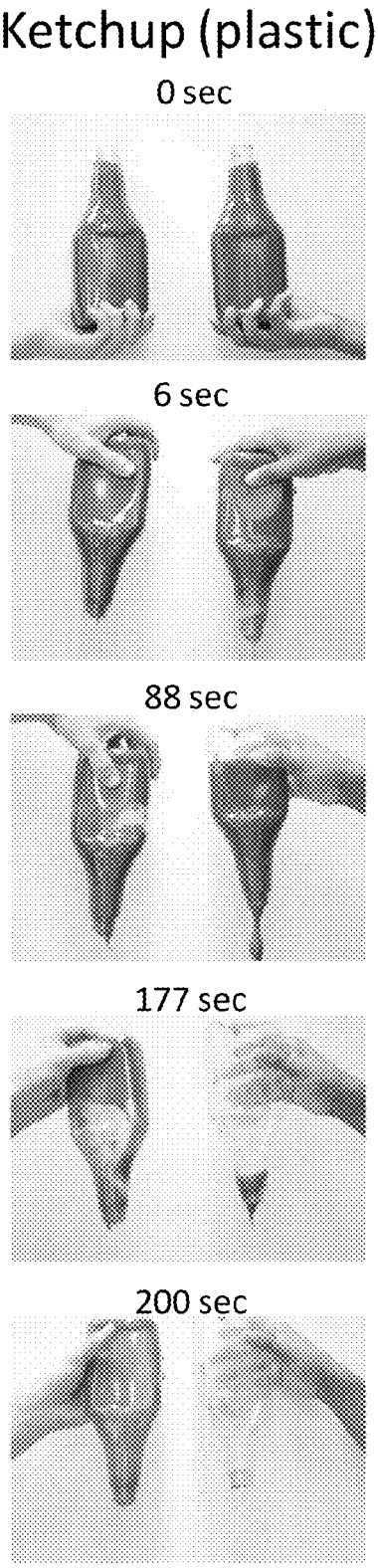
FIG. 14 includes a sequence of images of ketchup flowing out of a plastic bottle, in accordance with an illustrative embodiment of the invention.
Figure 15:
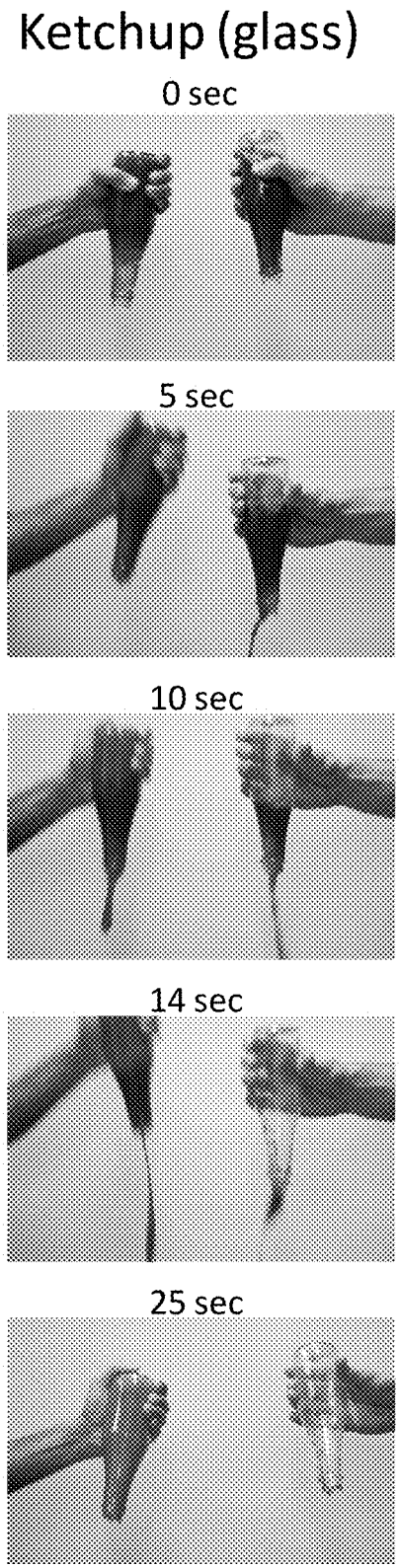
FIG. 15 includes a sequence of images of ketchup flowing out of a glass bottle, in accordance with an illustrative embodiment of the invention.

To prepare the liquid-impregnated surface for these images shown in FIGS. 14 and 15, an inner surface of a plastic (plastic Heinz bottles made from polyethylene terephthalate (PETE) or glass container was sprayed for a few seconds with a mixture containing particles of carnauba wax and a solvent. After the solvent evaporated, the carnauba wax that remained on the surface provided surface texture or roughness. The surface texture was then impregnated with ethyl oleate by applying the ethyl oleate to the surface and removing the excess ethyl oleate.

FIGS. 14 and 15 include two sequence of images of ketchup flowing out of a bottle, in accordance with an illustrative embodiment of the invention. The bottle on the left in each image is a standard ketchup bottle. The bottle on the right is a liquid-impregnated bottle. Specifically, the inner surfaces of the bottle on the right were liquid-impregnated prior to filling the bottle with ketchup. Aside from the different inner surfaces, the two bottles were identical. The sequence of images show ketchup flowing from the two bottles due to gravity. At time equal to zero, the initially full bottles were overturned to allow the ketchup to pour or drip from the bottles. As depicted, the ketchup drained considerably faster from the bottle having the liquid-impregnated surfaces. After 200 seconds, the amount of ketchup remaining in the standard bottle was 85.9 grams. By comparison, the amount of ketchup remaining in the liquid-impregnated bottle at this time was 4.2 grams.

The amount of carnauba wax on the surface of the bottle was about $9.9\times10^{-5}$ g/cm2. The amount of ethyl oleate in the liquid-impregnated surface was about $6.9\times10^{-4}$ g/cm2. The estimated coating thickness was from about 10 to about 30 micrometers.

Mustard

Figure 16:
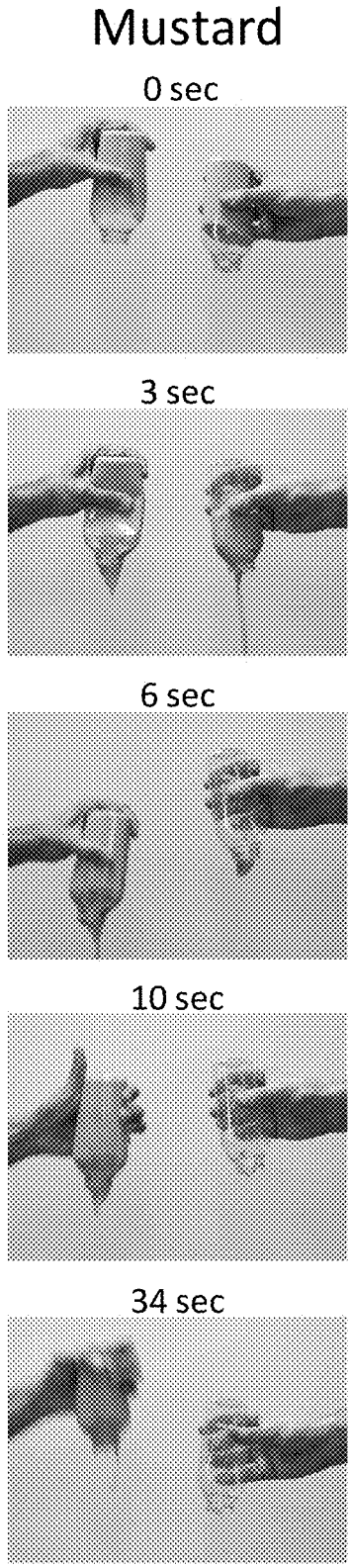
FIG. 16 includes a sequence of images of mustard flowing out of a bottle, in accordance with an illustrative embodiment of the invention.

To prepare the liquid-impregnated surface for these images shown in FIG. 16, an inner surface of a container was sprayed for a few seconds with a mixture containing particles of carnauba wax and a solvent. After the solvent evaporated, the carnauba wax that remained on the surface provided surface texture or roughness. The surface texture was then impregnated with ethyl oleate by applying the ethyl oleate to the surface and removing the excess ethyl oleate.

FIG. 16 includes a sequence of images of mustard flowing out of a bottle, in accordance with an illustrative embodiment of the invention. The bottle on the left in each image is a standard mustard bottle (Grey Poupon mustard bottle). The bottle on the right is a liquid-impregnated bottle. Specifically, the inner surfaces of the bottle on the right were liquid-impregnated prior to filling the bottle with mustard. Aside from the different inner surfaces, the two bottles were identical. The sequence of images show mustard flowing from the two bottles due to gravity. At time equal to zero, the initially full bottles were overturned to allow the mustard to pour or drip from the bottles. As depicted, the mustard drained considerably faster from the bottle having the liquid-impregnated surfaces.

Mayonnaise

Figure 17:
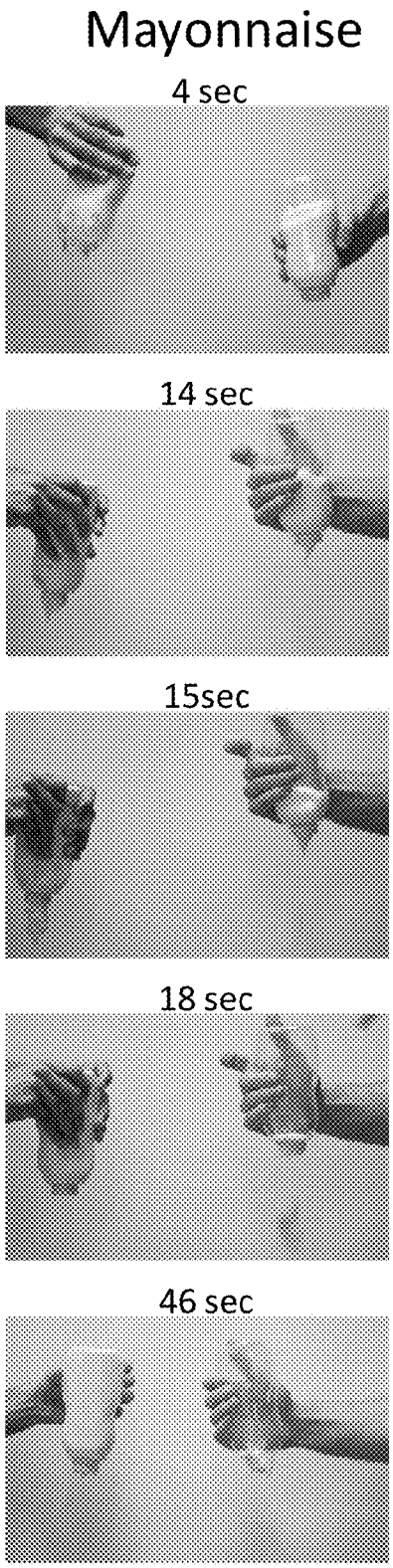
FIG. 17 includes a sequence of images of mayonnaise flowing out of a bottle, in accordance with an illustrative embodiment of the invention.

To prepare the liquid-impregnated surface for these images shown in FIG. 17, an inner surface of a container was sprayed for a few seconds with a mixture containing particles of carnauba wax and a solvent. After the solvent evaporated, the carnauba wax that remained on the surface provided surface texture or roughness. The surface texture was then impregnated with ethyl oleate by applying the ethyl oleate to the surface and removing the excess ethyl oleate.

FIG. 17 includes a sequence of images of mayonnaise flowing out of a bottle, in accordance with an illustrative embodiment of the invention. The bottle on the left in each image is a standard mayonnaise bottle (The Hellman's Mayonnaise bottle). The bottle on the right is a liquid-impregnated bottle. Specifically, the inner surfaces of the bottle on the right were liquid-impregnated prior to filling the bottle with mayonnaise. Aside from the different inner surfaces, the two bottles were identical. The sequence of images show mayonnaise flowing from the two bottles due to gravity. At time equal to zero, the initially full bottles were overturned to allow the mayonnaise to pour or drip from the bottles. As depicted, the mayonnaise drained considerably faster from the bottle having the liquid-impregnated surfaces.

Two days later, the experiment was repeated and the coated bottle of mayonnaise still emptied substantially completely.

Jelly

Figure 18:
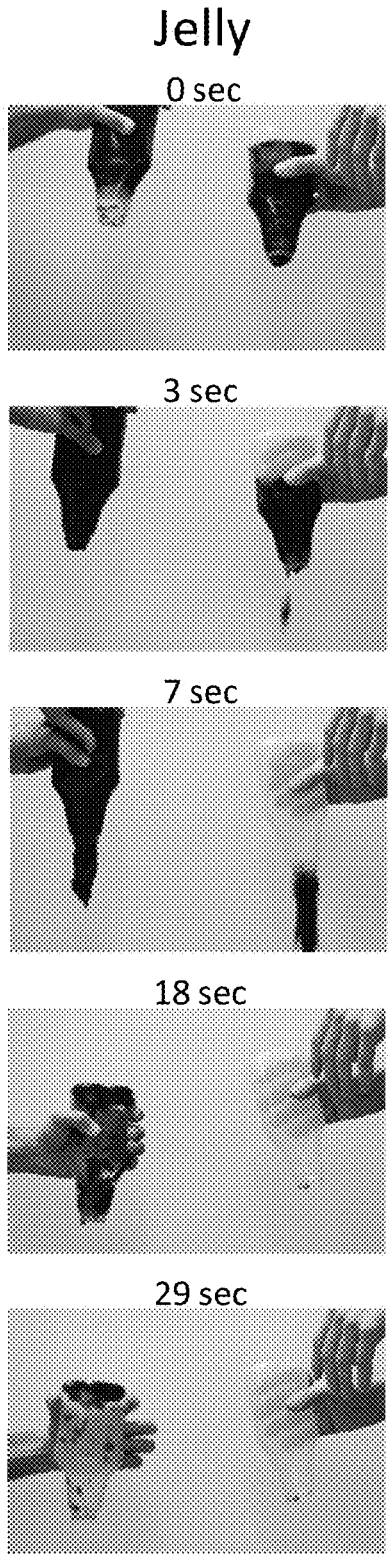
FIG. 18 includes a sequence of images of jelly flowing out of a bottle, in accordance with an illustrative embodiment of the invention.

To prepare the liquid-impregnated surface for these images shown in FIG. 18, an inner surface of a container was sprayed for a few seconds with a mixture containing particles of carnauba wax and a solvent. After the solvent evaporated, the carnauba wax that remained on the surface provided surface texture or roughness. The surface texture was then impregnated with ethyl oleate by applying the ethyl oleate to the surface and removing the excess ethyl oleate.

FIG. 18 includes a sequence of images of jelly flowing out of a bottle, in accordance with an illustrative embodiment of the invention. The bottle on the left in each image is a standard jelly bottle. The bottle on the right is a liquid-impregnated bottle. Specifically, the inner surfaces of the bottle on the right were liquid-impregnated prior to filling the bottle with jelly. Aside from the different inner surfaces, the two bottles were identical. The sequence of images show jelly flowing from the two bottles due to gravity. At time equal to zero, the initially full bottles were overturned to allow the jelly to pour or drip from the bottles. As depicted, the jelly drained considerably faster from the bottle having the liquid-impregnated surfaces.

In addition, experiments were tested at 55° C. in a liquid-impregnated bottle with jelly. The liquid-impregnated surface was stable and showed similar conveying effect.

Sour Cream and Onion Dip

Figure 19:
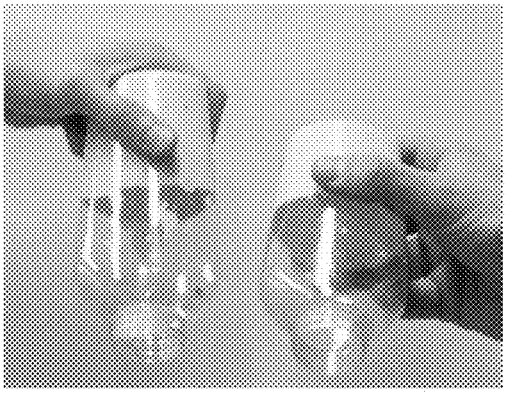
FIG. 19 includes a sequence of images of sour cream and onion dip flowing out of a bottle, in accordance with an illustrative embodiment of the invention.
Figure 19:
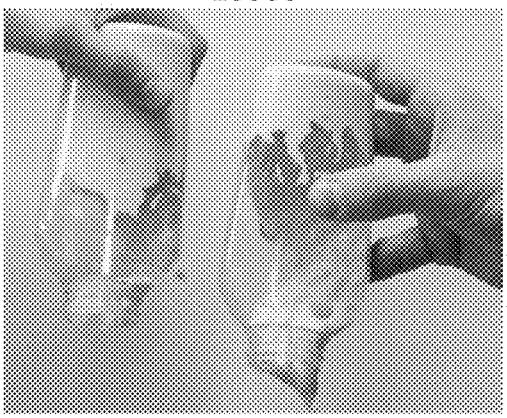
Figure 19:
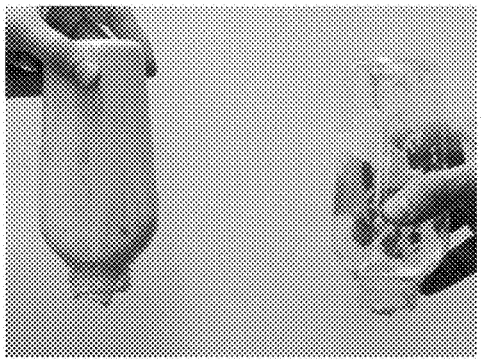

To prepare the liquid-impregnated surface for these images shown in FIG. 19, an inner surface of a container was sprayed for a few seconds with a mixture containing particles of carnauba wax and a solvent. After the solvent evaporated, the carnauba wax that remained on the surface provided surface texture or roughness. The surface texture was then impregnated with canola oil by applying the canola oil to the surface and removing the excess canola oil.

FIG. 19 includes a sequence of images of cream flowing out of a bottle, in accordance with an illustrative embodiment of the invention. The bottle on the left in each image is a standard bottle. The bottle on the right is a liquid-impregnated bottle. Specifically, the inner surfaces of the bottle on the right were liquid-impregnated prior to filling the bottle with cream. Aside from the different inner surfaces, the two bottles were identical. The sequence of images show cream flowing from the two bottles due to gravity. At time equal to zero, the initially full bottles were overturned to allow the cream to pour or drip from the bottles. As depicted, the cream drained considerably faster from the bottle having the liquid-impregnated surfaces.

Yogurt

Figure 20:
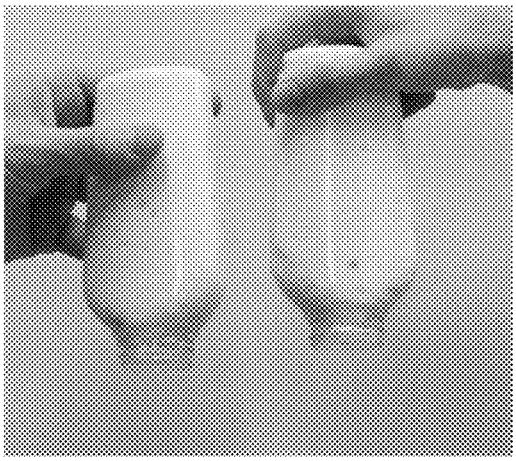
FIG. 20 includes a sequence of images of yogurt flowing out of a bottle, in accordance with an illustrative embodiment of the invention.
Figure 20:
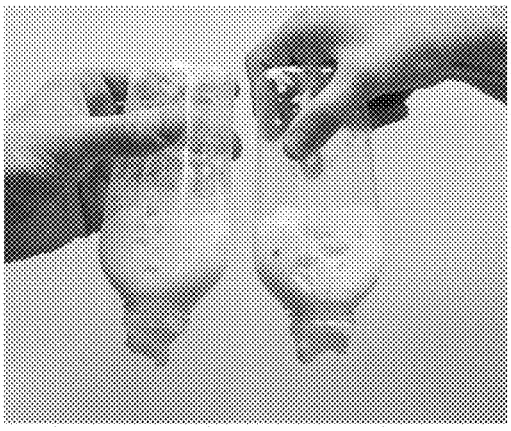
Figure 20:
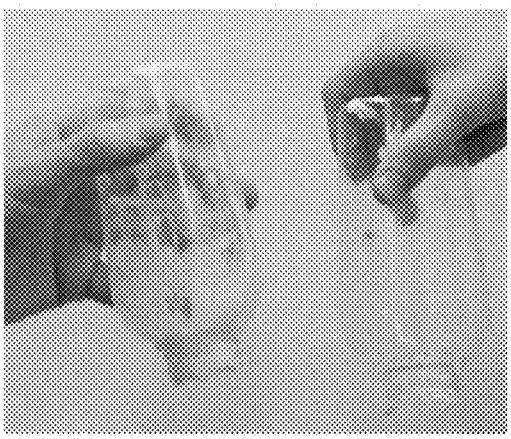

To prepare the liquid-impregnated surface for these images shown in FIG. 20, an inner surface of a container was sprayed for a few seconds with a mixture containing particles of carnauba wax and a solvent. After the solvent evaporated, the carnauba wax that remained on the surface provided surface texture or roughness. The surface texture was then impregnated with ethyl oleate by applying the ethyl oleate to the surface and removing the excess ethyl oleate.

FIG. 20 includes a sequence of images of yogurt flowing out of a bottle, in accordance with an illustrative embodiment of the invention. The bottle on the left in each image is a standard bottle. The bottle on the right is a liquid-impregnated bottle. Specifically, the inner surfaces of the bottle on the right were liquid-impregnated prior to filling the bottle with yogurt. Aside from the different inner surfaces, the two bottles were identical. The sequence of images show yogurt flowing from the two bottles due to gravity. At time equal to zero, the initially full bottles were overturned to allow the yogurt to pour or drip from the bottles. As depicted, the yogurt drained considerably faster from the bottle having the liquid-impregnated surfaces.

Toothpaste

Figure 21:
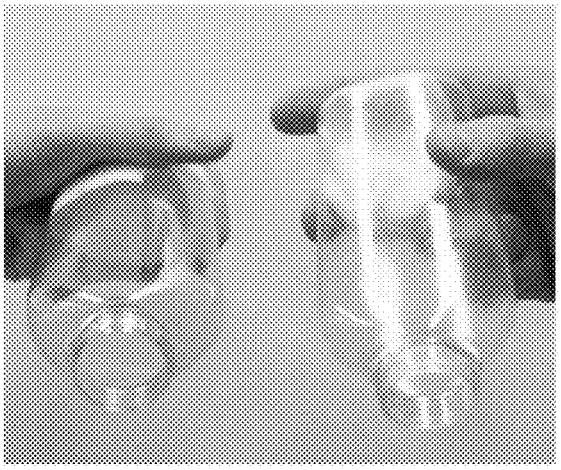
FIG. 21 includes a sequence of images of toothpaste flowing out of a bottle, in accordance with an illustrative embodiment of the invention.
Figure 21:
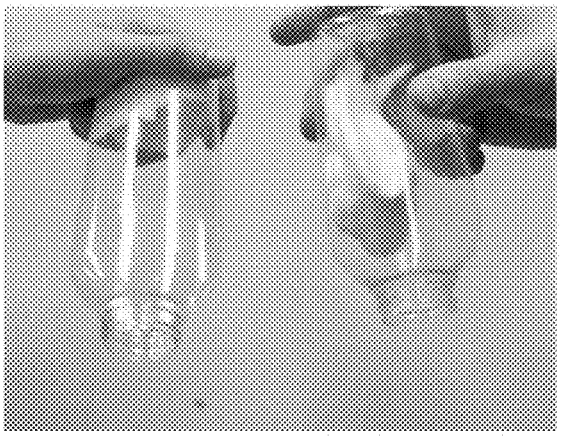
Figure 21:
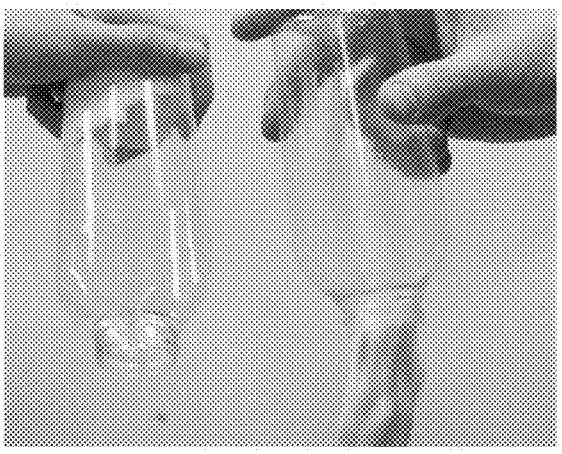

To prepare the liquid-impregnated surface for these images shown in FIG. 21, an inner surface of a container was sprayed for a few seconds with a mixture containing particles of carnauba wax and a solvent. After the solvent evaporated, the carnauba wax that remained on the surface provided surface texture or roughness. The surface texture was then impregnated with ethyl oleate by applying the ethyl oleate to the surface and removing the excess ethyl oleate.

FIG. 21 includes a sequence of images of toothpaste flowing out of a bottle, in accordance with an illustrative embodiment of the invention. The bottle on the left in each image is a standard bottle. The bottle on the right is a liquid-impregnated bottle. Specifically, the inner surfaces of the bottle on the right were liquid-impregnated prior to filling the bottle with toothpaste. Aside from the different inner surfaces, the two bottles were identical. The sequence of images show toothpaste flowing from the two bottles due to gravity. At time equal to zero, the initially full bottles were overturned to allow the toothpaste to pour or drip from the bottles. As depicted, the toothpaste drained considerably faster from the bottle having the liquid-impregnated surfaces.

Hair Gel

Figure 22:
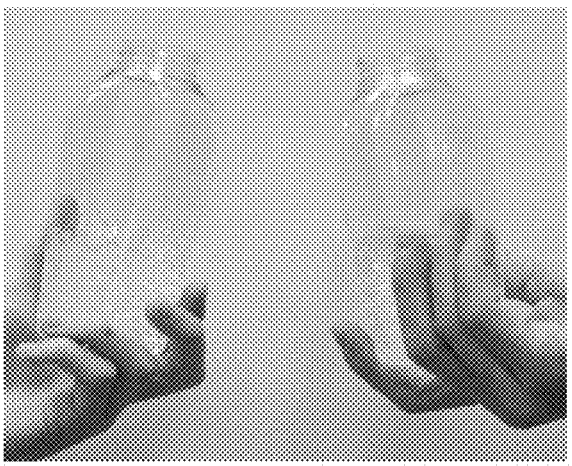
FIG. 22 includes a sequence of images of hair gel flowing out of a bottle, in accordance with an illustrative embodiment of the invention.
Figure 22:
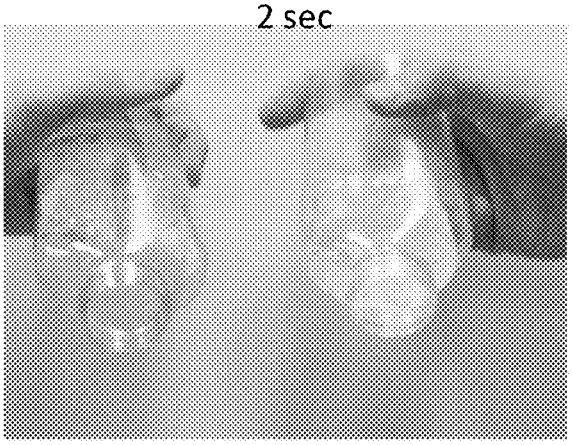
Figure 22:
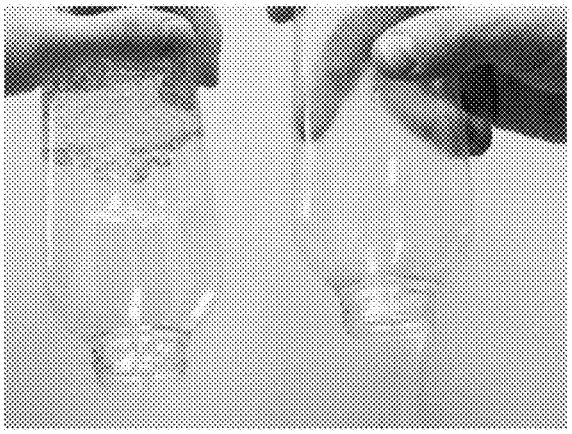

To prepare the liquid-impregnated surface for these images shown in FIG. 22, an inner surface of a container was sprayed for a few seconds with a mixture containing particles of carnauba wax and a solvent. After the solvent evaporated, the carnauba wax that remained on the surface provided surface texture or roughness. The surface texture was then impregnated with ethyl oleate by applying the ethyl oleate to the surface and removing the excess ethyl oleate.

FIG. 22 includes a sequence of images of hair gel flowing out of a bottle, in accordance with an illustrative embodiment of the invention. The bottle on the left in each image is a standard bottle. The bottle on the right is a liquid-impregnated bottle. Specifically, the inner surfaces of the bottle on the right were liquid-impregnated prior to filling the bottle with hair gel. Aside from the different inner surfaces, the two bottles were identical. The sequence of images show hair gel flowing from the two bottles due to gravity. At time equal to zero, the initially full bottles were overturned to allow the hair gel to pour or drip from the bottles. As depicted, the hair gel drained considerably faster from the bottle having the liquid-impregnated surfaces.

Data from Bottle Emptying Experiments

The weight of food remaining in both the coated and uncoated bottles used in the above-described experiments was recorded and is presented in Table 1 below. As is clear, the weight of product remaining in the bottles with liquid encapsulated interior surfaces ("coated bottles") after emptying is significantly less than the weight of product remaining in the bottles without the liquid encapsulated surfaces.

TABLE 1

Weight of food remaining for coated and uncoated bottles

| | Weight remaining in coated bottle | Weight remaining in uncoated bottle | Time of shaking |
|---|---|---|---|
| Heinz ketchup (plastic) - 36 oz | 4 g | 86 g | 200 seconds |
| Heinz ketchup (glass) - 14 oz | 3 g | 41 g | 29 seconds |
| Welch's Jelly (plastic) - 22 oz | 1 g | 48 g | 30 seconds |
| Grey Poupon Mustard (plastic) - 10 oz | 2 g | 45 g | 36 seconds |
| Honey (plastic) | 9 g | 35 g | 125 seconds |
| Hellmann's Mayonnaise (plastic) - 22 oz | 9 g | 85 g | 46 seconds |

EQUIVALENTS

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. A method of manufacturing a container of a consumer product, the method comprising:

providing a substrate;

applying a texture to the substrate, the texture comprising a matrix of solid features spaced sufficiently close to stably contain a liquid therebetween and/or therewithin;

impregnating the matrix of solid features with the liquid such that the matrix of solid features stably contains the liquid therebetween and/or therewithin after manufacture of the container, wherein the container is configured to contain a substance different from the impregnating liquid during use of the container, wherein the solid features and the liquid are non-toxic and/or edible; and contacting the impregnated matrix of solid features with a consumer product, wherein the consumer product comprises at least one member selected from the group consisting of ketchup, catsup, mustard, mayonnaise, syrup, honey, jelly, peanut butter, chocolate syrup, shortening, butter, margarine, oleo, dip, yogurt, sour cream, cosmetics, shampoo, lotion, hair gel, and toothpaste.

2. The method of claim 1, wherein the solid features are particles.

3. The method of claim 2, wherein the applying step comprises spraying a mixture of a solid and a solvent onto the substrate.

4. The method of claim 3, wherein the solid comprises one or more members selected from the group consisting of insoluble fibers, purified wood cellulose, micro-crystalline cellulose, oat bran fiber, kaolinite, Japan wax, pulp, ferric oxide, iron oxide, sodium formate, sodium oleate, sodium palmitate, sodium sulfate, wax, carnauba wax, beeswax, candelilla wax, zein (from corn), dextrin, cellulose ether, Hydroxyethyl cellulose, Hydroxypropyl cellulose (HPC), Hydroxyethyl methyl cellulose, Hydroxypropyl methyl cellulose (HPMC), and Ethyl hydroxyethyl cellulose.

5. The method of claim 3, comprising allowing the solvent to evaporate following the spraying of the mixture onto the substrate and before the impregnating step.

6. The method of claim 1, wherein the liquid comprises at least one member selected from the group consisting of a food additive, fatty acids, proteins, and a vegetable oil.

7. The method of claim 1, wherein applying the texture to the substrate comprises a procedure selected from the group consisting of exposing the substrate to a solvent, extruding or blow-molding a mixture of materials, roughening the substrate with mechanical action, spray-coating, polymer spinning, depositing particles from solution, extruding or blow-molding a foam or foam-forming material, depositing a polymer from a solution, extruding or blow-molding a material that expands upon cooling to leave a wrinkled or textured surface, applying a layer of material onto a surface that is under tension or compression, performing non-solvent induced phase separation of a polymer to obtain a porous structure, performing micro-contact printing, performing laser rastering, performing nucleation of the solid texture out of vapor, performing anodization, milling, machining, knurling, e-beam milling, performing thermal or chemical oxidation, and performing chemical vapor deposition.

8. The method of claim 1, wherein applying the texture to the substrate comprises spraying a mixture of edible particles onto the substrate.

9. The method of claim 1, further comprising chemically modifying the substrate prior to applying the texture to the substrate and/or chemically modifying the solid features of the texture.

10. The method of claim 1, wherein impregnating the matrix of solid features comprises removing a portion of the liquid that is not impregnated between or within the matrix of solid features from the matrix of solid features.

11. The method of claim 10, wherein removing the portion of the liquid that is not impregnated between or within the matrix of solid features comprises a procedure selected from the group consisting of using a second immiscible liquid to carry away the portion of the liquid that is not impregnated between or within the matrix of solid features, using mechanical action to remove the portion of the liquid that is not impregnated between or within the matrix of solid features, absorbing the portion of the liquid that is not impregnated between or within the matrix of solid features using a porous material, and draining the portion of the liquid that is not impregnated between or within the matrix of solid features off of the matrix of solid features using gravity or centrifugal forces.

12. The method of claim 1, wherein the solid features have an average dimension in a range of up to 200 microns.

13. The method of claim 1, wherein the particles are randomly spaced.

14. The method of claim 1, wherein the particles are arranged with average spacing of up to 200 microns between adjacent particles or clusters of particles.

15. The method of claim 1, wherein the liquid is stably contained between and/or within the matrix of solid features after manufacture of the container regardless of orientation of the container.

* * * * *